US008046314B2

(12) United States Patent
Graf et al.

(10) Patent No.: US 8,046,314 B2
(45) Date of Patent: Oct. 25, 2011

(54) APPARATUS, METHOD AND SYSTEM FOR STOCHASTIC WORKFLOW IN OILFIELD OPERATIONS

(75) Inventors: Thomas Graf, La Defense (FR); Georg Zangl, Laxenburg (AT)

(73) Assignee: Schlumberger Technology Corporation, Houston, TX (US)

( * ) Notice: Subject to any disclaimer, the term of this patent is extended or adjusted under 35 U.S.C. 154(b) by 687 days.

(21) Appl. No.: 12/175,429

(22) Filed: Jul. 17, 2008

(65) Prior Publication Data

US 2009/0020284 A1 Jan. 22, 2009

Related U.S. Application Data

(60) Provisional application No. 60/951,188, filed on Jul. 20, 2007.

(51) Int. Cl.

| | |
|---|---|
| ***G06F 15/18*** | (2006.01) |
| ***G06E 1/00*** | (2006.01) |
| ***G06E 3/00*** | (2006.01) |
| ***G06G 7/00*** | (2006.01) |
| ***G06N 3/02*** | (2006.01) |

(52) U.S. Cl. ..... 706/15

(58) Field of Classification Search ..... 706/15–44
See application file for complete search history.

(56) References Cited

U.S. PATENT DOCUMENTS

| | | | | |
|---|---|---|---|---|
| 5,992,519 | A | 11/1999 | Ramakrishnan et al. | |
| 6,018,497 | A | 1/2000 | Gunasekera et al. | |
| 6,078,869 | A | 6/2000 | Gunasekera et al. | |
| 6,106,561 | A | 8/2000 | Farmer | |
| 6,230,101 | B1 | 5/2001 | Wallis | |
| 6,266,619 | B1 * | 7/2001 | Thomas et al. | 702/13 |
| 6,313,837 | B1 | 11/2001 | Assa et al. | |
| 6,549,879 | B1 | 4/2003 | Cullick et al. | |
| 6,901,391 | B2 * | 5/2005 | Storm et al. | 706/16 |
| 6,980,940 | B1 | 12/2005 | Gurpinar et al. | |

(Continued)

FOREIGN PATENT DOCUMENTS

GB 2336008 10/1999

(Continued)

OTHER PUBLICATIONS

Klie, H., et al., "Models, methods and middleware for grid-enabled multiphysics oil reservoir management," Engineering with Computers, Dec. 2006, vol. 22, pp. 349-370, ISSN 0177-0667.

(Continued)

*Primary Examiner* — Michael B Holmes
*Assistant Examiner* — Ilya Traktovenko
(74) *Attorney, Agent, or Firm* — Osha Liang LLP

(57) ABSTRACT

The invention relates to a method for performing an oilfield operation. The method steps include obtaining oilfield data sets associated with oilfield entities, generating a stochastic database from the oilfield data sets based on an artificial neural network of the oilfield data sets, screening the oilfield data sets to identify candidates from the oilfield entities, wherein the screening is based on the stochastic database, performing a detail evaluation of each candidates, selecting an oilfield entity from the candidates based on the detail evaluation, and performing the oilfield operation for the selected oilfield entity.

23 Claims, 15 Drawing Sheets

U.S. PATENT DOCUMENTS

| | | | | |
|---|---|---|---|---|
| 7,164,990 | B2 | 1/2007 | Bratvedt et al. | |
| 7,430,501 | B2 * | 9/2008 | Feraille et al. | 703/10 |
| 7,433,851 | B2 * | 10/2008 | Mirowski | 706/19 |
| 7,481,275 | B2 * | 1/2009 | Olsvik et al. | 166/303 |
| 7,895,241 | B2 * | 2/2011 | Schoen et al. | 707/802 |
| 2003/0132934 | A1 | 7/2003 | Fremming | |
| 2003/0216897 | A1 | 11/2003 | Endres et al. | |
| 2004/0220846 | A1 | 11/2004 | Cullick et al. | |
| 2005/0149307 | A1 | 7/2005 | Gurpinar et al. | |
| 2006/0184329 | A1 | 8/2006 | Rowan et al. | |
| 2006/0197759 | A1 | 9/2006 | Fremming | |
| 2007/0112547 | A1 | 5/2007 | Ghorayeb et al. | |

FOREIGN PATENT DOCUMENTS

| | | |
|---|---|---|
| WO | 9964896 | 12/1999 |
| WO | 2004049216 | 6/2004 |
| WO | 2005122001 | 12/2005 |

OTHER PUBLICATIONS

Goel, Vikas et al., "A stochastic programming approach to planning of offshore gas field developments under uncertainty in reserves," Computers & Chemical Engineering, 2004, vol. 28, pp. 1409-1429.

* cited by examiner

| Category | Base Parameters |
|---|---|
| Reserves & Volumes | Volume Gas |
| | Volume Oil |
| | Area Gas |
| | Area Oil |
| | EV 6P OOIP |
| | EV 6P Reserves Oil |
| | UNRISKED OOIP |
| | Cumulative OII 2005 |
| | Produced Oil 2005 |
| | Cumulative Water Injection 2005 |
| | WF start date |
| | Oil Contingent Resources P4-P6 |
| | Developed Oil Reserves |
| | Proved Oil Reserves |
| | Plant Condensate Yield |
| | Pool Condensate Yield |
| | NGL Yield |
| | Discovery Year |
| | Best Depth |
| | Bubble Point Pressure |
| | Datum Depth |
| | Oil Compressibility |
| | Oil Depth |
| | Oil FVF |
| | Oil Gravity |
| | Oil Porosity |
| | Oil Thickness |
| Reservoir Rock & Fluid Properties | Oil Viscosity |
| | Permeability |
| | Reservoir Temperature |
| | Residual Oil Saturation |
| | Shrinkage |
| | Solution GOR |
| | Water Saturation Oil |
| | Z-Factor |
| Pressures | Abandonment Pressure |
| | Gas Abandonment Pressure |
| | Gas Initial Pressure |
| | Initial Pressure |
| | Initial Pressure Date |
| | Initial Pressure Estimated |
| | Last Pressure Estimated |
| | Last Pressure Estimated Date |

| Category | Base Parameters |
|---|---|
| Derived from Base Parameters | EV Pool Condensate Ultimate Recovery |
| | EV Free Gas Ultimate Recovery |
| | EV SLN Gas Ultimate Recovery |
| | EV Oil Ultimate Recovery |
| | EV 6P Ultimate Recovery |
| | UNRISKED Pool Cond Ultimate Recovery |
| | UNRISKED Free Gas Ultimate Recovery |
| | UNRISKED SLN Gas Ultimate Recovery |
| | UNRISKED Oil Ultimate Recovery |
| | Total Gas Revovery Factor 2005 |
| | Free Gas Revovery Factor 2005 |
| | SLN Gas Revovery Factor 2005 |
| | Max Oil Recovery Factor |
| | 6P Ultimate Oil Recovery Factor |
| | 6P Current Oil Recovery Factor |
| | Approximate Reservoir bbl OOIP |
| | Approximate Reservoir bbl Free GIIP |
| | Approximate Reservoir bbl Oil Voidage |
| | Approximate HCPV Voidage |
| | Gas Cap m ratio Reservoir OOIP |
| | Gas Cap m ratio Reservoir Free GIIP |
| | Gas Cap m ratio GRV Gas |
| | Gas Cap m ratio GRV Oil |
| | Gas Cap m Relative Difference |
| | Prim Gas Cap m from Free GIIP OOIP FVF |
| | Prim Gas Cap m from ratio of GRVs |
| | Ratio of % Press Depl to % HCPV voided |
| | % Depletion 6P Oil Cumulative/Ultimate |
| | Cumulative Rp/Rsi |
| | Initial SLN GOR from SLN GIIP OOIP |
| | Pressure Depletion % |
| | Pressure Depletion Absolute |
| | Reserves/Production Ratio 6P |
| | Fraction of Oil Reserves P4-P6 |
| | Fraction of Oil Reserves Developed |
| | Fraction of Oil Reserves Proved |
| | Appr Cum Oil Void Replacement Ratio |
| | Cumulative OOIP PV Injected |
| | Booked Volume Sweep Efficiency |

601

602

FIG. 6A

| Base Parameters | Completeness [%] |
|---|---|
| Initial Pressure Estimated | 86.7 |
| Oil Depth | 79.5 |
| Oil Gravity | 70.5 |
| Oil Porosity | 68.6 |
| Water Saturation Oil | 68.4 |
| Solution GOR | 68.1 |
| FVF Oil | 67.5 |
| EV 6P OOIP | 65.7 |
| Volume Oil | 65.6 |
| Residual Oil Saturation | 65.4 |
| Area Oil | 65.3 |
| Oil Thickness | 65.3 |
| Reservoir Temperature | 61.6 |
| Bubble Point Pressure | 56.2 |
| Remaining So CALC | 55.5 |
| Shrinkage | 53.6 |
| EV 6P Reserves Oil | 49.1 |
| Cumulative Oil 2005 | 29.6 |
| Abandonment Pressure | 27.8 |
| # of BHPs | 26.8 |
| Date of Last Pressure Estimated | 26.8 |
| Proved Oil Reserves | 22.4 |
| Oil Viscosity | 18.5 |
| Developed Oil Reserves | 17.8 |
| Oil Produced 2005 | 12.3 |
| Oil Compressibility | 9.4 |
| Oil Contingent Resources P4-P6 | 8.1 |
| Permeability | 4.5 |
| WF start date | 2.3 |
| Cumulative Water Injection 2005 | 2.3 |
| Dew Point Pressure | 0.8 |

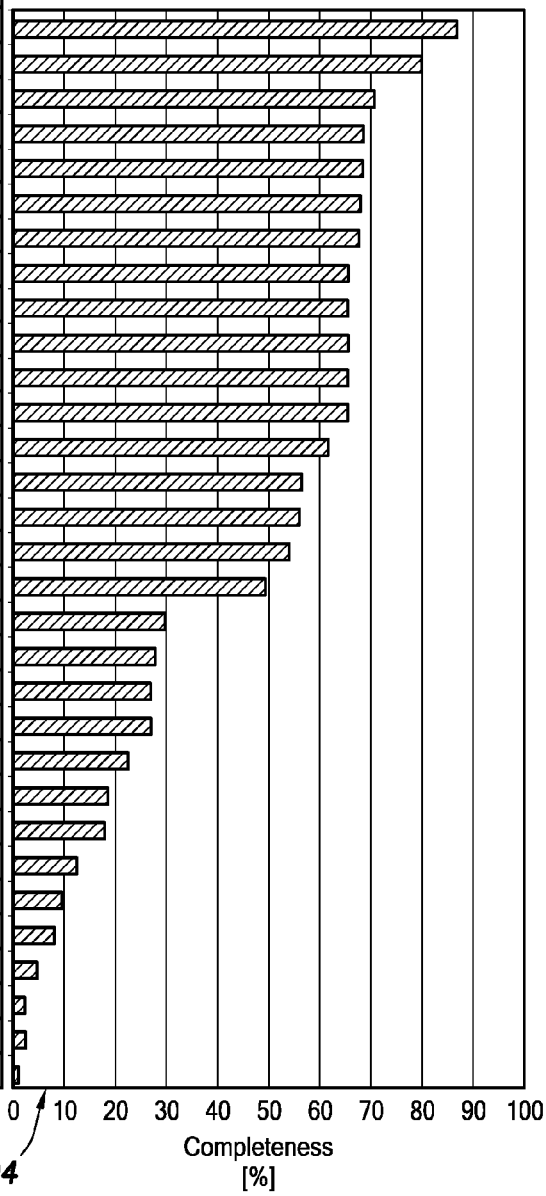

603

604

FIG.6B

APPARATUS, METHOD AND SYSTEM FOR STOCHASTIC WORKFLOW IN OILFIELD OPERATIONS

CROSS REFERENCE TO RELATED APPLICATIONS

This application claims priority under 35 U.S.C. §119(e) from Provisional Patent Application Ser. No. 60/951,188 filed Jul. 20, 2007 and is a Continuation-in-Part of U.S. patent application Ser. No. 11/595,508, entitled "Method for History Matching a Simulation Model using Self Organizing Maps to Generate Regions in the Simulation Model", filed Nov. 10, 2006, which claims priority under 35 U.S.C. §119(e) from Provisional Patent Application Ser. No. 60/774,589, filed Feb. 17, 2006.

BACKGROUND

1. Field of the Invention

The present invention relates to techniques for performing oilfield operations relating to subterranean formations having reservoirs therein. More particularly, the invention relates to techniques for performing oilfield operations involving an analysis of reservoir operations, and their impact on such oilfield operations.

2. Background of the Related Art

Oilfield operations, such as surveying, drilling, wireline testing, completions, simulation, planning and oilfield analysis, are typically performed to locate and gather valuable downhole fluids. Various aspects of the oilfield and its related operations are shown in FIGS. 1A-1D. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present, and if they are reasonably accessible.

As shown in FIG. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing.

After the drilling operation is complete, the well may then be prepared for simulation. As shown in FIG. 1D, wellbore completions equipment is deployed into the wellbore to complete the well in preparation for the simulation of fluid therethrough. Fluid is then drawn from downhole reservoirs, into the wellbore and flows to the surface. Simulation facilities are positioned at surface locations to collect the hydrocarbons from the wellsite(s). Fluid drawn from the subterranean reservoir(s) passes to the simulation facilities via transport mechanisms, such as tubing. Various equipments may be positioned about the oilfield to monitor oilfield parameters and/or to manipulate the oilfield operations.

During the oilfield operations, data is typically collected for analysis and/or monitoring of the oilfield operations. Such data may include, for example, subterranean formation, equipment, historical and/or other data. Data concerning the subterranean formation is collected using a variety of sources. Such formation data may be static or dynamic. Static data relates to, for example, formation structure and geological stratigraphy that define the geological structure of the subterranean formation. Dynamic data relates to, for example, fluids flowing through the geologic structures of the subterranean formation over time. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples may be used to take physical specimens of the formation at various depths as shown in FIG. 1B. Well logging typically involves deployment of a downhole tool into the wellbore to collect various downhole measurements, such as density, resistivity, etc., at various depths. Such well logging may be performed using, for example, the drilling tool of FIG. 1B and/or the wireline tool of FIG. 1C. Once the well is formed and completed, fluid flows to the surface using simulation tubing as shown in FIG. 1D. As fluid passes to the surface, various dynamic measurements, such as fluid flow rates, pressure, and composition may be monitored. These parameters may be used to determine various characteristics of the subterranean formation.

Sensors may be positioned about the oilfield to collect data relating to various oilfield operations. For example, sensors in the drilling equipment may monitor drilling conditions, sensors in the wellbore may monitor fluid composition, sensors located along the flow path may monitor flow rates, and sensors at the processing facility may monitor fluids collected. Other sensors may be provided to monitor downhole, surface, equipment or other conditions. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict downhole conditions, and make decisions concerning oilfield operations. Such decisions may involve well planning, well targeting, well completions, operating levels, simulation rates and other operations and/or conditions. Often this information is used to determine when to drill new wells, re-complete existing wells, or alter wellbore simulation.

Data from one or more wellbores may be analyzed to plan or predict various outcomes at a given wellbore. In some cases, the data from neighboring wellbores or wellbores with similar conditions or equipment may be used to predict how a well will perform. There are usually a large number of variables and large quantities of data to consider in analyzing oilfield operations. It is, therefore, often useful to model the behavior of the oilfield operation to determine the desired course of action. During the ongoing operations, the operating conditions may need adjustment as conditions change and new information is received.

Techniques have been developed to model the behavior of various aspects of the oilfield operations, such as geological structures, downhole reservoirs, wellbores, surface facilities as well as other portions of the oilfield operation. Examples of these modeling techniques are shown in Patent/Publication/Application Nos. U.S. Pat. No. 5,992,519, WO2004/049216, WO1999/064896, WO2005/122001, U.S. Pat. No. 6,313,837, US2003/0216897, US2003/0132934, US2005/0149307, US2006/0197759, U.S. Pat. No. 6,980,940, US2004/0220846, and Ser. No. 10/586,283. Techniques have also been developed for performing reservoir simulation operations. See, for example, Patent/Publication/Application Nos. U.S. Pat. No. 6,230,101, U.S. Pat. No. 6,018,497, U.S. Pat. No. 6,078,869, GB2336008, U.S. Pat. No. 6,106,561, US2006/0184329, U.S. Pat. No. 7,164,990.

Examples of oilfield operations include Enhanced Oil Recovery (EOR) processes to extend field life and increase ultimate oil recovery from naturally depleting reservoirs. Enhanced oil recovery can begin at any time during the productive life of an oil reservoir. Its purpose is not only to restore formation pressure, but also to improve oil displacement or fluid flow in the reservoir. The three major types of enhanced oil recovery operations are chemical flooding (alkaline flooding or micellar-polymer flooding), miscible displacement (carbon dioxide injection or hydrocarbon injection), and thermal recovery (steamflood, waterflood, or in-situ combustion). The optimal application of each type depends on reservoir temperature, pressure, depth, net pay, permeability, residual oil and water saturations, porosity and fluid properties such as oil API gravity and viscosity.

Steamflood is a method of thermal recovery in which steam generated at surface is injected into the reservoir through specially distributed injection wells. When steam enters the reservoir, it heats up the crude oil and reduces its viscosity. The heat also distills light components of the crude oil, which condense in the oil bank ahead of the steam front, further reducing the oil viscosity. The hot water that condenses from the steam and the steam itself generate an artificial drive that sweeps oil toward producing wells. Another contributing factor that enhances oil production during steam injection is related to near-wellbore cleanup. In this case, steam reduces the interfacial tension that ties paraffins and asphaltenes to the rock surfaces while steam distillation of crude oil light ends creates a small solvent bank that can miscibly remove trapped oil.

Waterflooding is among the oldest and perhaps most economical of EOR processes. Hot waterflooding is a method of thermal recovery in which hot water is injected into a reservoir through specially distributed injection wells. Hot waterflooding reduces the viscosity of the crude oil, allowing it to move more easily toward production wells. Hot waterflooding, also known as hot water injection, is typically less effective than a steam-injection process because water has lower heat content than steam. Nevertheless, it is preferable under certain conditions such as formation sensitivity to fresh water.

Current high oil prices provide incentive for companies to look deeper into their reservoir portfolios for additional EOR (e.g., waterflooding) opportunities. Time and information constraints can limit the depth and rigor of such a screening evaluation. Time is reflected by the effort of screening a vast number of reservoirs for the applicability of implementing an EOR (e.g., waterflooding), whereas information is reflected by the availability of data (consistency of measured and modeled data) with which to extract significant knowledge necessary to make good development decisions.

Examples of oilfield operations also include the installation of intelligent completions to improve the economics of production. These wells allow access not only to marginal reservoirs, for which dedicated production might not be economic, but also accelerate the recovery. Monitoring flow-control and other devices can be used to manage the production from the commingled reservoirs and optimize the recovery.

Regulatory bodies usually demand that the operator can allocate the production to the individual reservoirs for reserves accounting purposes. Unless flow meters for each completion are installed, back-allocation from the wellhead to the completion is difficult to achieve. Traditional methods that could deliver the production share in real-time fail to provide accurate results when the inflow performance of one completion changes. Numerical modeling, which accounts for the mobility change and the resulting re-distribution of the pressure in the open system of the completion, is time consuming and cannot be used for back-allocation in real-time.

Despite the development and advancement of reservoir simulation techniques in oilfield operations, there remains a need to consider the effects of large number of reservoirs and uncertainty in accurate numerical well models on oilfield operations. It would be desirable to provide techniques to screen large number of candidates for selecting, planning and/or implementing oilfield operations based on static and dynamic aspects of the oilfield. It would also be desirable to perform back-allocation of commingling wells in real-time. It is further desirable that such techniques selectively consider desired parameters, such as measured data or modeled data with uncertainty in accuracy or consistency. Such desired techniques may be capable of one of more of the following, among others: providing screening capability for reducing the number of reservoir candidates (i.e., reservoir candidates to be evaluated in mode detail for selection to perform oilfield operations) by one or more order of magnitude, providing modeling capability to evaluate sensitivities and uncertainties of influencing parameters, and providing modeling capability to speed up the screening process without jeopardizing the quality of the results.

SUMMARY

In general, in one aspect, the invention relates to a method for performing an oilfield operation. The method steps include obtaining oilfield data sets associated with oilfield entities, generating a stochastic database from the oilfield data sets based on an artificial neural network of the oilfield data sets, screening the oilfield data sets to identify candidates from the oilfield entities, wherein the screening is based on the stochastic database, performing a detail evaluation of each candidates, selecting an oilfield entity from the candidates based on the detail evaluation, and performing the oilfield operation for the selected oilfield entity.

In general, in one aspect, the invention relates to a method for performing an oilfield operation. The method steps include obtaining a plurality of oilfield data sets associated with a plurality of oilfield entities, each of the plurality of oilfield data sets comprising a plurality of data fields, at least one data field of the plurality of data fields of at least one oilfield data set of the plurality of oilfield data sets being an un-populated data field, generating a first artificial neural network of the plurality of oilfield data sets, the first artificial neural network comprising one or more relationships among the plurality of data fields, populating the un-populated data field of the at least one oilfield data set by an estimated data based on the one or more relationships to generate a back-populated oilfield data set, and performing the oilfield operation based on at least the back-populated oilfield data set.

In general, in one aspect, the invention relates to a method of performing an oilfield operation, comprising, obtaining a plurality of oilfield data sets associated with a plurality of oilfield entities, each of the plurality of oilfield data sets comprising a plurality of data fields, generating an artificial neural network of the plurality of oilfield data sets, the artificial neural network being associated with one or more key performance indicators (KPIs) of the oilfield operation identified from the plurality of data fields, identifying a plurality of clusters from the plurality of oilfield entities base on the artificial neural network, each of the plurality of clusters comprises one or more oilfield entities of the plurality of oilfield entities, generating a plurality of proxy models corresponding to the plurality of clusters, each of the plurality of proxy models modeling the oilfield operation of the one or more oilfield entities of a corresponding cluster, and performing the oilfield operation based on the plurality of proxy models.

In general, in one aspect, the invention relates to a surface unit comprising a memory and a processor, embodying instructions store in the memory and executable by the processor to perform method steps to perform an oilfield operation, the instructions comprising functionality to obtain a plurality of oilfield data sets associated with a plurality of oilfield entities, generate a stochastic database from the plurality of oilfield data sets based on an artificial neural network of the plurality of oilfield data sets, screen the plurality of oilfield data sets to identify a plurality of candidates from the plurality of oilfield entities, wherein the screening is based on the stochastic database, perform a detail evaluation of each of the plurality of candidates, select an oilfield entity from the plurality of candidates based on the detail evaluation, and perform the oilfield operation for the oilfield entity.

In general, in one aspect, the invention relates to a surface unit comprising a memory and a processor, embodying instructions store in the memory and executable by the processor to perform method steps to perform an oilfield operation, the instructions comprising functionality to obtain a plurality of oilfield data sets associated with a plurality of oilfield entities, each of the plurality of oilfield data sets comprising a plurality of data fields, at least one data field of the plurality of data fields of at least one oilfield data set of the plurality of oilfield data sets being an un-populated data field, generate a first artificial neural network of the plurality of oilfield data sets, the first artificial neural network comprising one or more relationships among the plurality of data fields, populate the un-populated data field of the at least one oilfield data set by an estimated data based on the one or more relationships to generate a back-populated oilfield data set, and perform the oilfield operation based on at least the back-populated oilfield data set.

In general, in one aspect, the invention relates to a surface unit comprising a memory and a processor, embodying instructions store in the memory and executable by the processor to perform method steps to perform an oilfield operation, the instructions comprising functionality to obtain a plurality of oilfield data sets associated with a plurality of oilfield entities, each of the plurality of oilfield data sets comprising a plurality of data fields, generate an artificial neural network of the plurality of oilfield data sets, the artificial neural network being associated with one or more key performance indicators (KPIs) of the oilfield operation identified from the plurality of data fields, identify a plurality of clusters from the plurality of oilfield entities base on the artificial neural network, each of the plurality of clusters comprises one or more oilfield entities of the plurality of oilfield entities, generate a plurality of proxy models corresponding to the plurality of clusters, each of the plurality of proxy models modeling the oilfield operation of the one or more oilfield entities of a corresponding cluster, and perform the oilfield operation based on the plurality of proxy models.

Other aspects and advantages of the invention will be apparent from the following description and the appended claims.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIG. 1A depicts an exemplary survey operation being performed by a seismic truck. FIG. 1B depicts an exemplary drilling operation being performed by a drilling tool suspended by a rig and advanced into the subterranean formation. FIG. 1C depicts an exemplary wireline operation being performed by a wireline tool suspended by the rig and into the wellbore of FIG. 1B. FIG. 1D depicts an exemplary simulation operation being performed by a simulation tool being deployed from the rig and into a completed wellbore for drawing fluid from the downhole reservoir into a surface facility.

FIG. 2A depicts an exemplary seismic trace of the subterranean formation of FIG. 1A. FIG. 2B depicts exemplary core sample of the formation shown in FIG. 1B. FIG. 2C depicts an exemplary well log of the subterranean formation of FIG. 1C. FIG. 2D depicts an exemplary simulation decline curve of fluid flowing through the subterranean formation of FIG. 1D.

FIGS. 6A and 6B shows exemplary oilfield data and a statistical chart in accordance with one or more embodiments of the invention.

DETAILED DESCRIPTION

Figure 1D:
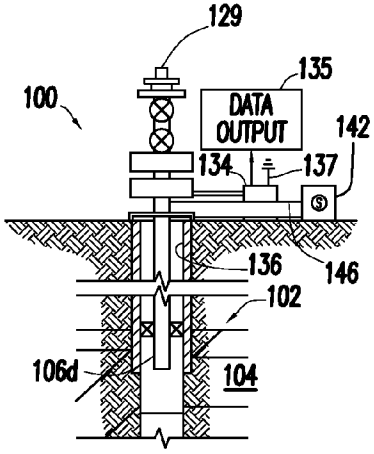
FIGS. 1A-1D show exemplary schematic views of an oilfield having subterranean structures including reservoirs therein and various oilfield operations being performed on the oilfield.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

FIGS. 1A-D show an oilfield (100) having geological structures and/or subterranean formations therein. As shown in these figures, various measurements of the subterranean formation are taken by different tools at the same location. These measurements may be used to generate information about the formation and/or the geological structures and/or fluids contained therein.

Figure 1C:
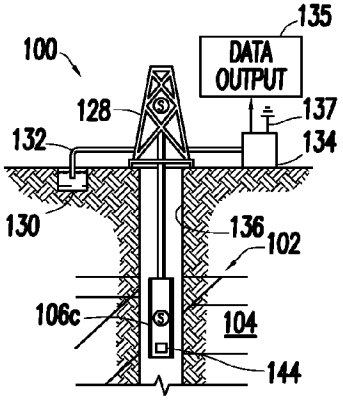
Figure 1B:
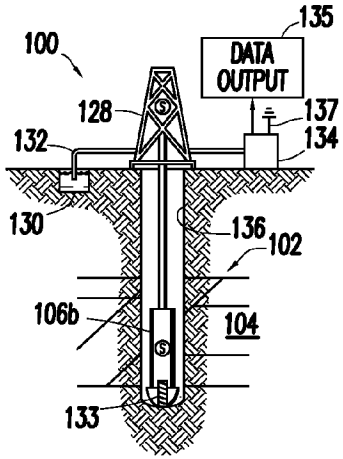
Figure 1A:
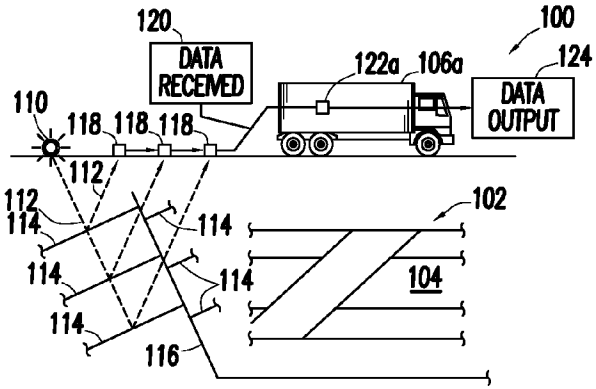

FIGS. 1A-1D depict schematic views of an oilfield (100) having subterranean formations (102) containing a reservoir (104) therein and depicting various oilfield operations being performed on the oilfield (100). FIG. 1A depicts a survey operation being performed by a seismic truck (106*a*) to measure properties of the subterranean formation. The survey operation is a seismic survey operation for producing sound vibrations. In FIG. 1A, one such sound vibration (112) is generated by a source (110) and reflects off a plurality of horizons (114) in an earth formation (116). The sound vibration(s) (112) is (are) received in by sensors (S), such as geophone-receivers (118), situated on the earth's surface, and the geophone-receivers (118) produce electrical output signals, referred to as data received (120) in FIG. 1.

In response to the received sound vibration(s) (112) representative of different parameters (such as amplitude and/or frequency) of the sound vibration(s) (112). The data received (120) is provided as input data to a computer (122*a*) of the seismic recording truck (106*a*), and responsive to the input data, the recording truck computer (122*a*) generates a seismic data output record (124). The seismic data may be further processed as desired, for example by data reduction.

FIG. 1B depicts a drilling operation being performed by a drilling tool (106*b*) suspended by a rig (128) and advanced into the subterranean formation (102) to form a wellbore (136). A mud pit (130) is used to draw drilling mud into the drilling tool (106*b*) via flow line (132) for circulating drilling mud through the drilling tool (106*b*) and back to the surface. The drilling tool (106*b*) is advanced into the formation to reach reservoir (104). The drilling tool (106*b*) is preferably adapted for measuring downhole properties. The drilling tool (106*b*) may also be adapted for taking a core sample (133) as shown, or removed so that a core sample (133) may be taken using another tool.

A surface unit (134) is used to communicate with the drilling tool (106*b*) and offsite operations. The surface unit (134) is capable of communicating with the drilling tool (106*b*) to send commands to drive the drilling tool (106*b*), and to receive data therefrom. The surface unit (134) is preferably provided with computer facilities for receiving, storing, processing, and analyzing data from the oilfield (100). The surface unit (134) collects data output (135) generated during the drilling operation. Computer facilities, such as those of the surface unit (134), may be positioned at various locations about the oilfield (100) and/or at remote locations.

Sensors (S), such as gauges, may be positioned throughout the reservoir, rig, oilfield equipment (such as the downhole tool), or other portions of the oilfield for gathering information about various parameters, such as surface parameters, downhole parameters, and/or operating conditions. These sensors (S) preferably measure oilfield parameters, such as weight on bit, torque on bit, pressures, temperatures, flow rates, compositions and other parameters of the oilfield operation.

The information gathered by the sensors (S) may be collected by the surface unit (134) and/or other data collection sources for analysis or other processing. The data collected by the sensors (S) may be used alone or in combination with other data. The data may be collected in a database and all or select portions of the data may be selectively used for analyzing and/or predicting oilfield operations of the current and/or other wellbores.

Data outputs from the various sensors (S) positioned about the oilfield may be processed for use. The data may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, reservoir engineering, and/or production simulations. The reservoir, wellbore, surface and/or process data may be used to perform reservoir, wellbore, or other production simulations. The data outputs from the oilfield operation may be generated directly from the sensors (S), or after some preprocessing or modeling. These data outputs may act as inputs for further analysis.

The data is collected and stored at the surface unit (134). One or more surface units (134) may be located at the oilfield (100), or linked remotely thereto. The surface unit (134) may be a single unit, or a complex network of units used to perform the necessary data management functions throughout the oilfield (100). The surface unit (134) may be a manual or automatic system. The surface unit (134) may be operated and/or adjusted by a user.

The surface unit (134) may be provided with a transceiver (137) to allow communications between the surface unit (134) and various portions of the oilfield (100) or other locations. The surface unit (134) may also be provided with or functionally linked to a controller for actuating mechanisms at the oilfield. The surface unit (134) may then send command signals to the oilfield (100) in response to data received. The surface unit (134) may receive commands via the transceiver or may itself execute commands to the controller. A processor may be provided to analyze the data (locally or remotely) and make the decisions to actuate the controller. In this manner, the oilfield (100) may be selectively adjusted based on the data collected to optimize fluid recovery rates, or to maximize the longevity of the reservoir and its ultimate production capacity. These adjustments may be made automatically based on computer protocol, or manually by an operator. In some cases, well plans may be adjusted to select optimum operating conditions, or to avoid problems.

FIG. 1C depicts a wireline operation being performed by a wireline tool (106*c*) suspended by the rig (128) and into the wellbore (136) of FIG. 1B. The wireline tool (106*c*) is preferably adapted for deployment into a wellbore (136) for performing well logs, performing downhole tests and/or collecting samples. The wireline tool (106*c*) may be used to provide another method and apparatus for performing a seismic survey operation. The wireline tool (106*c*) of FIG. 1C may have an explosive or acoustic energy source (143) that provides electrical signals to the surrounding subterranean formations (102).

The wireline tool (106*c*) may be operatively linked to, for example, the geophones (118) stored in the computer (122*a*) of the seismic recording truck (106*a*) of FIG. 1A. The wireline tool (106*c*) may also provide data to the surface unit (134). As shown data output (135) is generated by the wireline tool (106*c*) and collected at the surface. The wireline tool (106*c*) may be positioned at various depths in the wellbore (136) to provide a survey of the subterranean formation.

FIG. 1D depicts a production operation being performed by a production tool (106*d*) deployed from the rig (128) and into the completed wellbore (136) of FIG. 1C for drawing fluid from the downhole reservoirs into surface facilities (142). Fluid flows from reservoir (104) through wellbore (136) and to the surface facilities (142) via a gathering network (144). Sensors (S) positioned about the oilfield (100) are operatively connected to a surface unit (142) for collecting data therefrom. During the production process, data output (135) may be collected from various sensors (S) and passed to the surface unit (134) and/or processing facilities. This data may be, for example, reservoir data, wellbore data, surface data, and/or process data.

FIG. 1D depicts a production operation being performed by a production tool (106*d*) deployed from a production unit or christmas tree (129) and into the completed wellbore (136) of FIG. 1C for drawing fluid from the downhole reservoirs into the surface facilities (142). Fluid flows from reservoir (104) through perforations in the casing (not shown) and into the production tool (106*d*) in the wellbore (136) and to the surface facilities (142) via a gathering network (146).

Sensors (S), such as gauges, may be positioned about the oilfield to collect data relating to various oilfield operations as described previously. As shown, the sensor (S) may be positioned in the production tool (106*d*) or associated equipment, such as the Christmas tree (129), gathering network (146), surface facilities (142) and/or the production facility, to measure fluid parameters, such as fluid composition, flow rates, pressures, temperatures, and/or other parameters of the production operation.

While only simplified wellsite configurations are shown, it will be appreciated that the oilfield may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite(s).

While FIGS. 1B-1D depict tools used to measure properties of an oilfield (100), it will be appreciated that the tools may be used in connection with non-oilfield operations, such as mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation (102) and/or its geological formations may be used. Various sensors (S) may be located at various positions along the wellbore and/or the monitoring tools to collect and/or monitor the desired data. Other sources of data may also be provided from offsite locations.

The oilfield configuration in FIGS. 1A-1D are intended to provide a brief description of an example of an oilfield usable with the present invention. Part, or all, of the oilfield (100) may be on land and/or sea. Also, while a single oilfield measured at a single location is depicted, the present invention may be used with any combination of one or more oilfields (100), one or more processing facilities, and one or more wellsites.

Figure 2D:
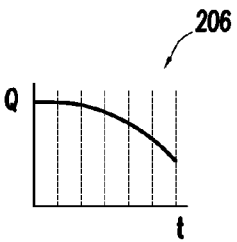
FIGS. 2A-2D are exemplary graphical depictions of data collected by the tools of FIGS. 1A-1D, respectively.
Figure 2C:
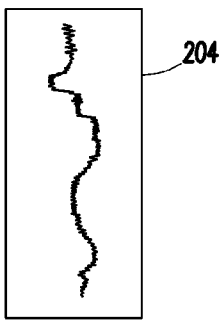
Figure 2B:
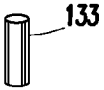
Figure 2A:
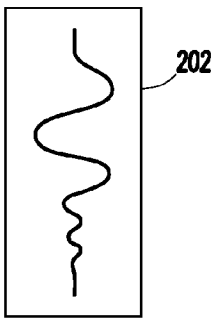

FIGS. 2A-2D are graphical depictions of data collected by the tools of FIGS. 1A-D, respectively. FIG. 2A depicts a seismic trace (202) of the subterranean formation of FIG. 1A taken by survey tool (106*a*). The seismic trace measures a two-way response over a period of time. FIG. 2B depicts a core sample (133) taken by the drilling tool (106*b*). The core test typically provides a graph of the density, resistivity, or other physical property of the core sample (133) over the length of the core. Tests for density and viscosity are often performed on the fluids in the core at varying pressures and temperatures. FIG. 2C depicts a well log (204) of the subterranean formation of FIG. 1C taken by the wireline tool (106*c*). The wireline log typically provides a resistivity measurement of the formation at various depts. FIG. 2D depicts a production decline curve (206) of fluid flowing through the subterranean formation of FIG. 1D taken by the production tool (106*d*). The production decline curve (206) typically provides the production rate Q as a function of time t.

The respective graphs of FIGS. 2A-2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties.

FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate models of the subterranean formation to determine characteristics thereof.

Figure 3:
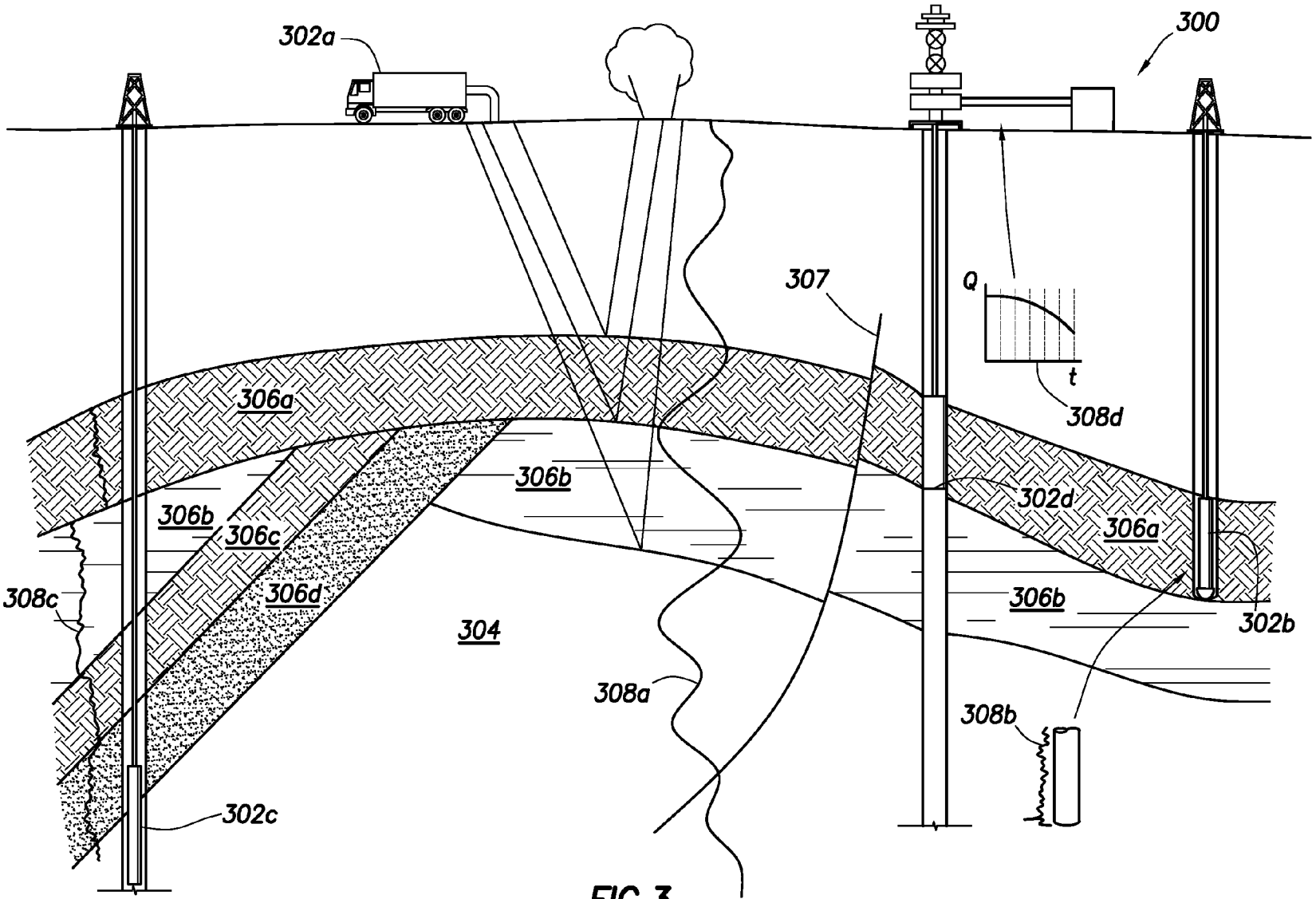
FIG. 3 shows an exemplary schematic view, partially in cross section, of an oilfield having a plurality of data acquisition tools positioned at various locations along the oilfield for collecting data from the subterranean formation.

FIG. 3 is a schematic view, partially in cross section of an oilfield (300) having data acquisition tools (302*a*), (302*b*), (302*c*), and (302*d*) positioned at various locations along the oilfield for collecting data of a subterranean formation (304). The data acquisition tools (302*a*-302*d*) may be the same as data acquisition tools (106*a*-106*d*) of FIG. 1, respectively. As shown, the data acquisition tools (302*a*-302*d*) generate data plots or measurements (308*a*-308*d*), respectively.

Data plots (308*a*-308*c*) are examples of static data plots that may be generated by the data acquisition tools (302*a*-302*d*), respectively. Static data plot (308*a*) is a seismic two-way response time and may be the same as the seismic trace (202) of FIG. 2A. Static plot (308*b*) is core sample data measured from a core sample of the formation (304), similar to the core sample (133) of FIG. 2B. Static data plot (308*c*) is a logging trace, similar to the well log (204) of FIG. 2C. Data plot (308*d*) is a dynamic data plot of the fluid flow rate over time, similar to the graph (206) of FIG. 2D. Other data may also be collected, such as historical data, user inputs, economic information, other measurement data, and other parameters of interest.

The subterranean formation (304) has a plurality of geological structures (306*a*-306*d*). As shown, the formation has a sandstone layer (306*a*), a limestone layer (306*b*), a shale layer (306*c*), and a sand layer (306*d*). A fault line (307) extends through the formation. The static data acquisition tools are preferably adapted to measure the formation and detect the characteristics of the geological structures of the formation.

While a specific subterranean formation (304) with specific geological structures are depicted, it will be appreciated that the formation may contain a variety of geological structures. Fluid may also be present in various portions of the formation. Each of the measurement devices may be used to measure properties of the formation and/or its underlying structures. While each acquisition tool is shown as being in specific locations along the formation, it will be appreciated that one or more types of measurement may be taken at one or more location across one or more oilfields or other locations for comparison and/or analysis.

The data collected from various sources, such as the data acquisition tools of FIG. 3, may then be evaluated. Typically, seismic data displayed in the static data plot (308*a*) from the data acquisition tool (302*a*) is used by a geophysicist to determine characteristics of the subterranean formation (304). Core data shown in static plot (308*b*) and/or log data from the well log (308*c*) is typically used by a geologist to determine various characteristics of the geological structures of the subterranean formation (304). Production data from the production graph (308*d*) is typically used by the reservoir engineer to determine fluid flow reservoir characteristics.

Figure 4:
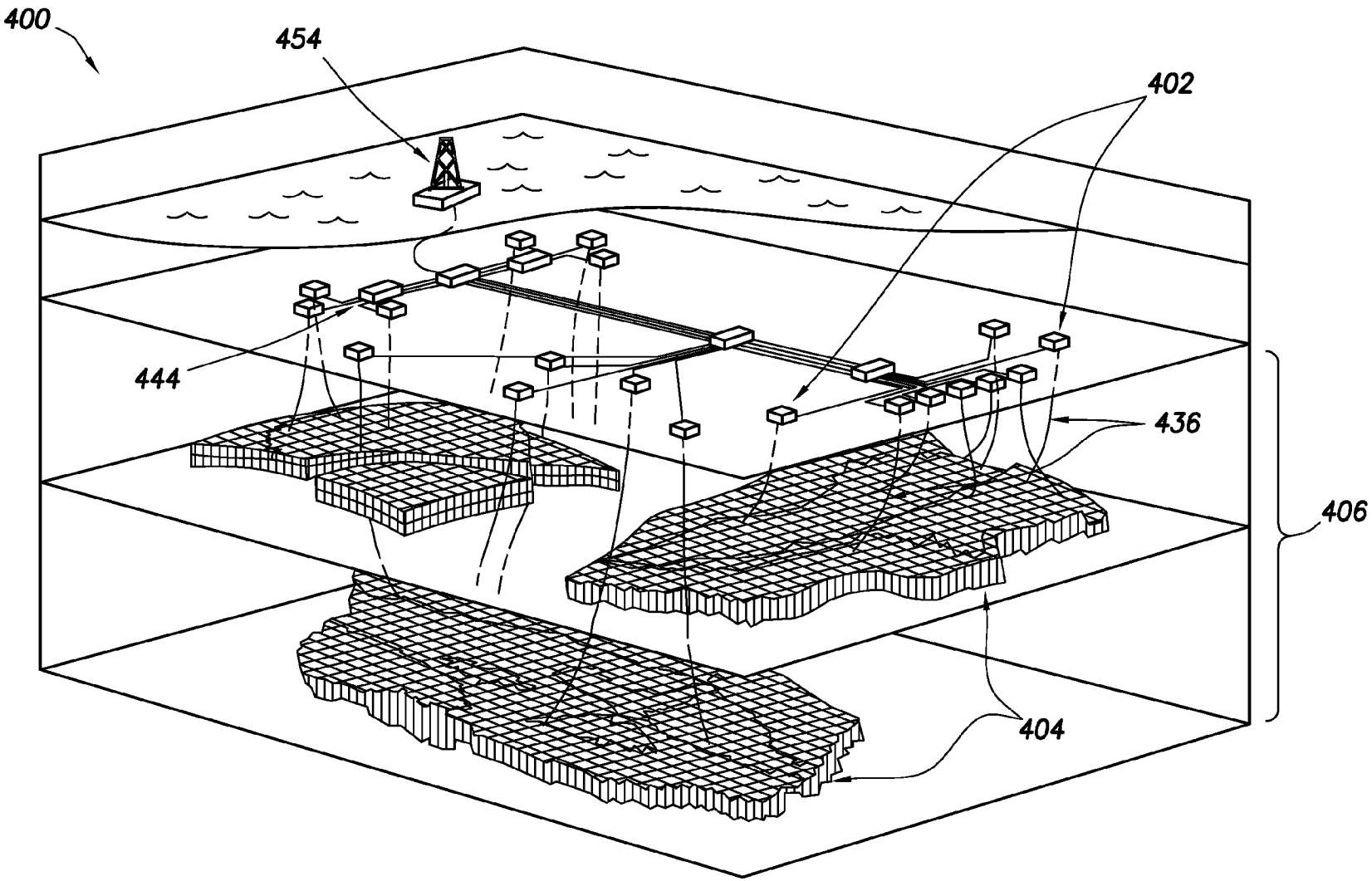
FIG. 4 shows an exemplary schematic view of an oilfield having a plurality of wellsites for producing oil from the subterranean formation.

FIG. 4 shows an oilfield (400) for performing simulation operations. As shown, the oilfield has a plurality of wellsites (402) operatively connected to a central processing facility (454). The oilfield configuration of FIG. 4 is not intended to limit the scope of the invention. Part or all of the oilfield may be on land and/or see. Also, while a single oilfield with a single processing facility and a plurality of wellsites is depicted, any combination of one or more oilfields, one or more processing facilities and one or more wellsites may be present.

Each wellsite (402) has equipment that forms a wellbore (436) into the earth. The wellbores extend through subterranean formations (406) including reservoirs (404). These reservoirs (404) contain fluids, such as hydrocarbons. The wellsites draw fluid from the reservoirs and pass them to the processing facilities via gathering networks (444). The gathering networks (444) have tubing and control mechanisms for controlling the flow of fluids from the wellsite to the processing facility (454).

Figure 5:
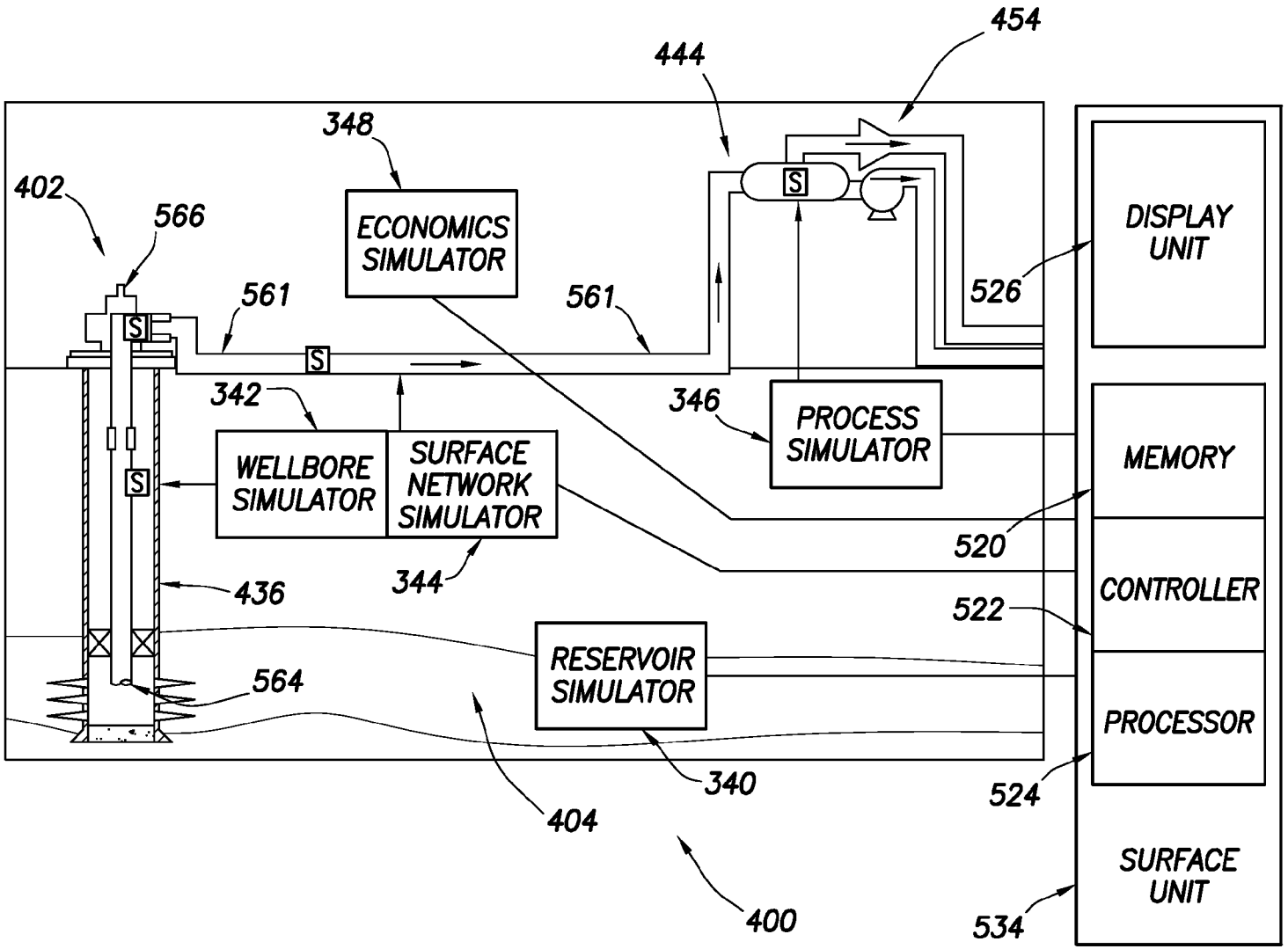
FIG. 5 shows an exemplary schematic diagram of a portion of the oilfield of FIG. 4 depicting the simulation operation in detail.

FIG. 5 shows a schematic view of a portion of the oilfield (400) of FIG. 4, depicting a wellsite (402) and gathering network (444) in detail. The wellsite (402) of FIG. 5 has a wellbore (436) extending into the earth therebelow. As shown, the wellbore (436) has already been drilled, completed, and prepared for simulation from reservoir (504).

Wellbore simulation equipment (564) extends from a wellhead (566) of wellsite (402) and to the reservoir (404) to draw fluid to the surface. The wellsite (402) is operatively connected to the gathering network (444) via a transport line (561). Fluid flows from the reservoir (404), through the wellbore (436), and onto the gathering network (444). The fluid then flows from the gathering network (444) to the process facilities (454).

As further shown in FIG. 5, sensors (S) are located about the oilfield (400) to monitor various parameters during oilfield operations. The sensors (S) may measure, for example, pressure, temperature, flow rate, composition, and other parameters of the reservoir, wellbore, gathering network, process facilities and/or other portions of the oilfield operation. These sensors (S) are operatively connected to a surface unit (534) for collecting data therefrom. The surface unit may be, for example, similar to the surface unit 134 of FIGS. 1A-D As shown in FIG. 5, the surface unit (534) has computer facilities, such as memory (520), controller (522), processor (524), and display unit (526), for managing the data. The data is collected in memory (520), and processed by the processor (524) for analysis. Data may be collected from the oilfield sensors (S) and/or by other sources. For example, oilfield data may be supplemented by historical data collected from other operations, or user inputs.

The analyzed data may then be used to make decisions. A transceiver (not shown) may be provided to allow communications between the surface unit (534) and the oilfield (400). The controller (522) may be used to actuate mechanisms at the oilfield (400) via the transceiver and based on these decisions. In this manner, the oilfield (400) may be selectively adjusted based on the data collected. These adjustments may be made automatically based on computer protocol and/or manually by an operator. In some cases, well plans are adjusted to select optimum operating conditions or to avoid problems.

A display unit (526) may be provided at the wellsite (402) and/or remote locations for viewing oilfield data (not shown). The oilfield data represented by a display unit (526) may be raw data, processed data and/or data outputs generated from various data. The display unit (526) is preferably adapted to provide flexible views of the data, so that the screens depicted may be customized as desired. A user may determine the desired course of action during simulation based on reviewing the displayed oilfield data. The simulation operation may be selectively adjusted in response to the display unit (526). The display unit (526) may include a display for viewing oilfield data or defining oilfield events. For example, the display may correspond to an output from a printer, plot, a monitor, or another device.

To facilitate the processing and analysis of data, simulators may be used to process the data. Specific simulators are often used in connection with specific oilfield operations, such as reservoir or wellbore simulation. Data fed into the simulator(s) may be historical data, real time data or combinations thereof. Simulation through one or more of the simulators may be repeated or adjusted based on the data received.

As shown, the oilfield operation is provided with wellsite and non-wellsite simulators. The wellsite simulators may include a reservoir simulator (340), a wellbore simulator (342), and a surface network simulator (344). The reservoir simulator (340) solves for hydrocarbon flow through the reservoir rock and into the wellbores. The wellbore simulator (342) and surface network simulator (344) solves for hydrocarbon flow through the wellbore and the surface gathering network (444) of pipelines. As shown, some of the simulators may be separate or combined, depending on the available systems.

Different reservoir simulators may be provided to depict various levels of approximation in mathematical representation of the reservoir. For example, the reservoir simulator (340) may be a full reservoir simulation model with increased accuracy, but reduced speed. The reservoir simulator (340) may be a tank model proxy of a reservoir simulator, which typically provides a simplified representation of a reservoir simulation model. This type of reservoir simulator is typically less accurate, but faster to solve. The reservoir simulator (340) may also be a lookup table proxy of a reservoir simulator, which is typically even more simplified and faster to solve. The tank model proxy and the lookup table proxy are examples of a proxy model.

The non-wellsite simulators may include process and economics simulators. The processing unit has a process simulator (346). The process simulator (346) models the processing plant (e.g., the process facility (454)) where the hydrocarbon is separated into its constituent components (e.g., methane, ethane, propane, etc.) and prepared for sales. The oilfield (400) is provided with an economics simulator (348). The economics simulator (348) models the costs of part or all of the oilfield throughout a portion or the entire duration of the gas operation. Various combinations of these and other oilfield simulators may be provided.

In general, the present invention relates to a method for screening a large number of oilfield entities (e.g., reservoirs, wells, completions, etc.) to identify one or more candidates for a more detailed phase evaluation. The screening method uses a wide variety of information types including field data, domain expertise and numerical models, while still satisfying a number of physical, financial, geopolitical and human constraints.

As an example, initially, available reservoir-level data set is back-populated (gap-filling) and subsequently analyzed using Self-Organizing Maps (SOMs), which are Neural Network algorithms used for multi-dimensional correlation. Next, a specific number of generic numerical models are built using the stochastic output from the first step. These models are used to create response surfaces to evaluate sensitivities and assess uncertainties of influencing parameters. Further, the reservoir uncertainties are combined with expert knowledge and environmental variables using Bayesian Networks, (i.e., probability reasoning engines). These are used as proxy models and act as objective functions, where the input parameters are assigned in a stochastic manner and the output is represented by a ranking of potential reservoir candidates.

Once reservoir candidates have been identified, each may undergo a more detailed evaluation to determine whether production and recovery of the reservoir may be improved by performing an oilfield operation on the reservoir (i.e., an enhanced oil recovery operation, a steamflood operation, a waterflood operation, etc.).

One of the biggest challenges in screening a large number of reservoirs for oilfield development planning is the availability and completeness of data. It is well known in the art that it is extremely difficult to have a complete and consistent set of complex oilfield data, such as production profiles, allocation or back-calculation from the export pipeline to the completion, etc. Even other more simplistic oilfield parameters may also be incomplete or with questionable accuracy for a large collection of reservoirs. In one or more embodiments of the invention, this deficiency in oilfield data and/or parameters may be a result of low frequencies in measurements, unknown losses in the system, inaccurate or incorrect measurements, subjective valuation (i.e., human error), etc.

In one or more embodiments of the invention, oilfield data and/or parameters can be grouped logically into base parameters and derived (or calculated) parameters. FIG. 6A shows exemplary oilfield data and/or parameters in accordance with one or more embodiments of the invention. As shown in FIG. 6A, the base parameters (601) are directly measured properties such as reservoir rock or fluid properties and pressures. The calculated parameters (602) may be derived from base parameters, for example generated using highly complex processes such as the calculation of the recovery factor using numerical means. In one or more embodiments of the invention, data and/or parameters in oilfield development planning phase, production phase, or other phases of oilfield operation may be stored as oilfield data sets in a database or other suitable formats of data storage. Each of the oilfield data sets may include a set of data fields (e.g., including any of the base parameters (601) and calculated parameters (602) of FIG. 6A) corresponding to a reservoir in a collection of reservoirs.

FIG. 6B shows a statistical chart depicting the completeness of oilfield data sets in a database for an exemplar collection of reservoirs. This exemplary statistical chart includes the tabulated data completeness (603) of base parameters and corresponding bar chart (604) for the collection of reservoirs. For example, the most available reservoir parameter "Initial Pressure Estimated" and the second most available reservoir parameter "Oil Depth" are shown to be available for 86.7% and 79.5% of the reservoirs in the collection, respectively. In one or more embodiments of the invention, the deficiency or un-populated data fields (e.g., Initial Pressure Estimated, Oil Depth, etc.) in the set of data fields (e.g., the base parameters of FIG. 6B) exist in a portion of the collection of reservoirs (e.g., 13.3% and 20.5%, respectively) due to technical, environmental, subjective, or other contributing factors. These contributing factors may be static or may change with time during the development phase or other phases of oilfield operation. For example, once data are modified, adjusted, or otherwise changed to newer information with time, the changed data may create inconsistencies with other parameters in the database. In general, the indication that certain data have changed during the history is typically lost or not being maintained in the database. For certain types of oilfield parameters, (e.g., reservoir depth), inconsistency and incompleteness may be easily detected; but some other parameters (e.g., derived data such as in-place-volumes or ultimate recoveries) are extremely difficult to identify as inconsistent in the database.

Further as shown in FIG. 6B, reservoir parameters important for field development planning such as "Oil Viscosity" and "Permeability" are nearly completely missing (i.e., 18.5% and 4.5% available, respectively) in the database. In general, generation of these parameters require elaborate measurements and detailed interpretation, which are not feasible to be performed for the entire collection of reservoirs. Although the examples given in FIG. 6B describe data completeness of base parameters, those skilled in the art will recognize that the description is equally applicable to calculated parameters and/or other oilfield data/parameters.

Incomplete and inconsistent database are detrimental to portfolio or asset management for a reservoir collection as decisions can not be made with certainty. For example if a decision needs to be made to identify the reservoirs with the highest impact (e.g., return on the investment) from a water injection (e.g., waterflooding) operation, the large number of reservoirs with missing oil viscosity parameter in the database may not be considered. Furthermore, reservoirs with inconsistent parameters (e.g., "in-place-volume" parameter showing inconsistency to other measured pressure parameters) may not be used in the screening process. Therefore, the resultant ranking from the screening process would only highlight reservoirs with high data completeness and consistency without including other potentially desirable candidate reservoirs with data deficiency.

In one or more embodiments of the invention, the database may be back-populated with synthetic data that reflect the best estimate so as to elevate reservoirs with data deficiency allowing them to survive through the screening process. In order to assess the accuracy of the back-populated data, a stochastic database is generated where each parameter is associated with probability information (e.g., probability distribution, combination of mean value, standard deviation, and uncertainty, or other suitable probability information) allowing the quantification of the certainty of data and providing a confidence level for the synthetic and/or original data.

Although the examples given above and descriptions with respect to FIGS. 6A and 6B relate to reservoir-level data sets and screening for reservoir candidates, those skilled in the art will recognize that the method is equally applicable to other oilfield entities such as well-level data sets/well candidates, completion-level data sets/completion candidates, etc.

Figure 7A:
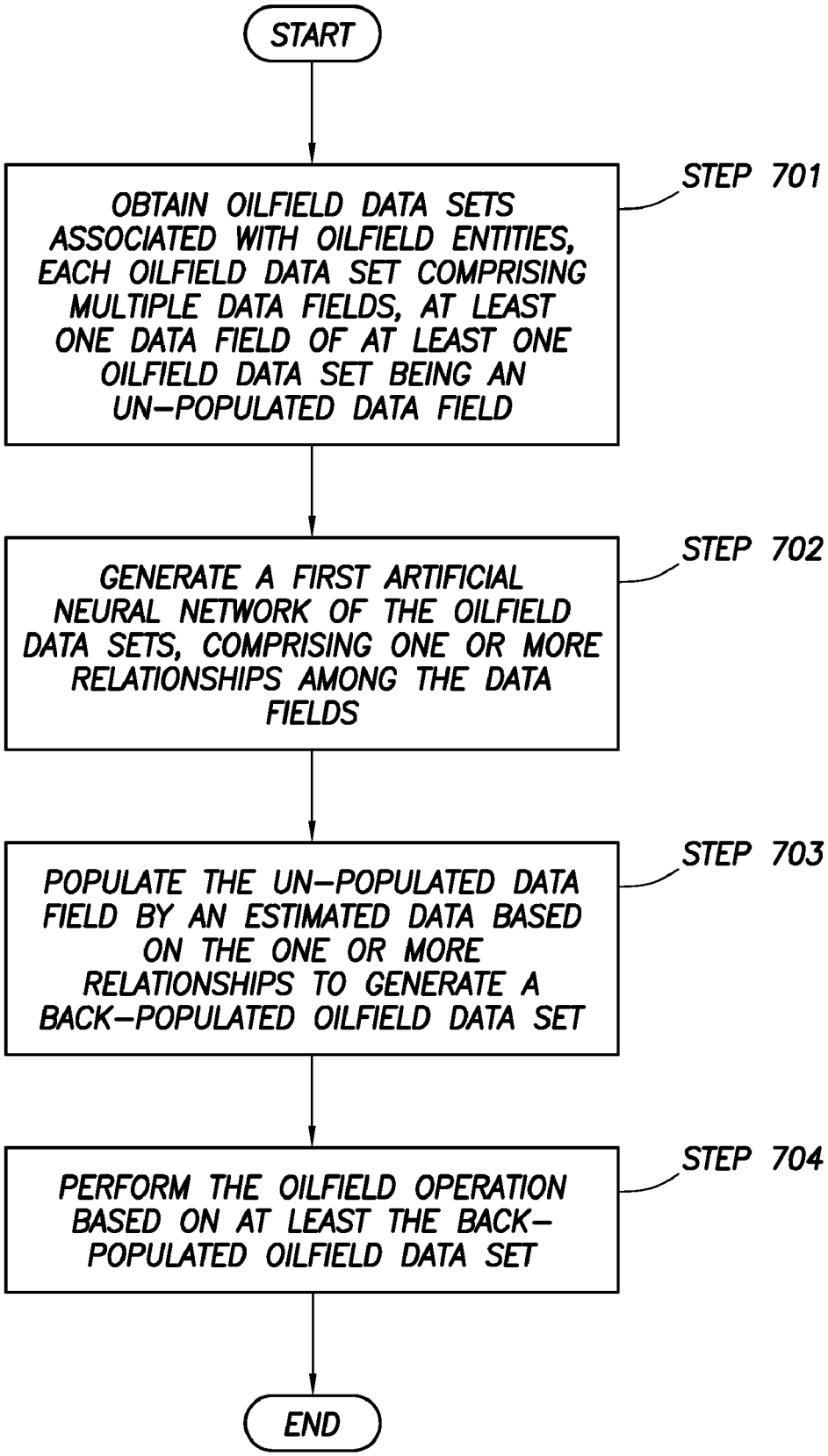
FIGS. 7A and 7B shows a flow chart and an exemplary depiction of a method for back-populating a stochastic database in accordance with one or more embodiments of the invention.
Figure 7B:
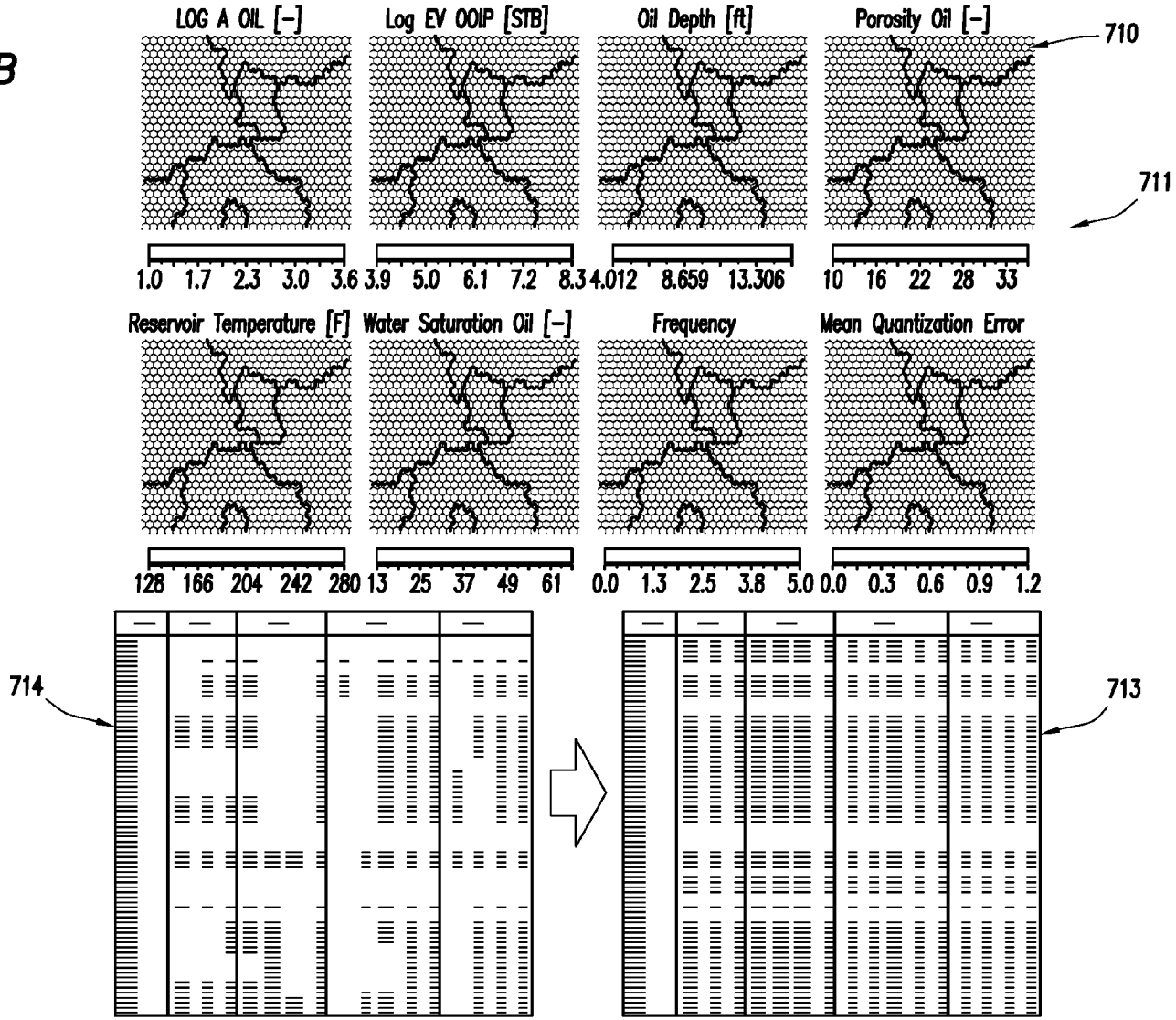

FIGS. 7A and 7B show a flow chart and an exemplary depiction of a method for back-populating a stochastic database in accordance with one or more embodiments of the invention. In one or more embodiments of the invention, one or more of the steps shown in FIGS. 7A and 7B may be omitted, repeated, and/or performed in a different order. Accordingly, embodiments of the invention should not be considered limited to the specific arrangements of steps shown in FIGS. 7A and 7B.

The method as shown in FIGS. 7A and 7B may be practiced in the oilfield described with respect to FIGS. 1A-5 above. Initially, oilfield data sets (e.g., organized in an exemplary data table (714)) associated with a collection of oilfield entities (e.g., a large number of reservoirs) may be obtained (Step 701). Each of the oilfield data sets (e.g., each row of data table (714)) corresponds to an oilfield entity (e.g., identified by the first column of data table (714)) and includes multiple data fields (e.g., identified in multiple fields of the first row of data table (714)) such as the base parameters and/or calculated parameters described with respect to FIGS. 6A and 6B above. Based on exemplary statistics described with respect to FIG. 6B and further as shown in the exemplary data table (714) of FIG. 7A, these data fields are not completely populated for all the reservoirs. In these examples, at least one data field of at least one oilfield data set is unpopulated for a corresponding oilfield entity (e.g., a reservoir).

A first artificial neural network of these oilfield data sets may then be generated (Step 702). As is known in the art, artificial neural network is a mathematical model consisting of an interconnected group of neurons (or nodes) that collectively process inputs of the network to generation outputs where the interconnected neurons has an adaptive structure that changes based on input/output information provided to the network in a learning phase. In one or more embodiments of the invention, the first artificial neural network may be used as a non-linear statistical data modeling tool to model one or more relationships among the multiple data fields.

In the example of reservoir-level data fields (e.g., of FIGS. 6A and 6B), some of the relationships may be straight forward as many data in reservoir-level data fields are linked to each other. For example the reservoir depth is typically linearly related to the reservoir temperature, logarithmically related to the permeability, and in some cases related by a power law to the reservoir size (assuming the deeper the reservoir the more compartmentalized are the strata due to cumulative tectonic events). Oil density, formation volume factor, gas oil ratio (GOR), and viscosity may also be deduced from one to the other and may be linked to the depth. However, in general, such simple relationships are not sufficient to describe all the statistical patterns exhibited in the oilfield data sets for a large collection of reservoirs.

In one or more embodiments of the invention, portions of the first artificial neural network may be constructed using various portions of the data fields (e.g., reservoir-level data fields of FIGS. 6A and 6B) as inputs and outputs of the network where training data are based on oilfield data sets having these various portions of the data fields fully populated to be used as the inputs and outputs of the network in the training phase. In one or more embodiments of the invention, for a large collection of oilfield entities (e.g., reservoirs), high order multi-dimensional connections between the various data fields corresponding to these inputs and outputs may be established based on non-linear, multi-layered, parallel regression capabilities inherent in an artificial neural network such as the first artificial neural network. In one or more embodiments of the invention, these high order multi-dimensional connections of the first artificial neural network represent statistical (or data-driven) relationships among the data fields to supplement the more simple and straight forward relationships described above to fully describe all the statistical patterns exhibited in the oilfield data sets for a collection of oilfield entities (e.g., a large number of reservoirs).

Returning to FIG. 7A based on the description above, the unpopulated data field of the at least one oilfield data set described with respect to Step 701 may then be populated by estimated data derived from these statistical relationships to generate a back-populated oilfield data set (e.g., the exemplary data table (713)) (Step 703). In one or more embodiments of the invention, the unpopulated data field may be an output of a portion of the first artificial neural network where the inputs correspond to other populated data fields of the at least one data set for the corresponding oilfield entity (e.g., a reservoir). Accordingly, an estimated data (i.e., reconstructed data or synthetic data) may be derived for this unpopulated data field based on these other populated data fields using the relationships corresponding to the portion of the first artificial neural network. In one or more embodiments of the invention, the at least one oilfield data set may be back-populated using the estimated data as back-populated data to fill the unpopulated data field. In one or more embodiments of the invention, the originally populated data fields may also be compared to estimated data derived from these statistical relationships to generate probability information such as probability distribution or combination of mean value, standard deviation, and uncertainty.

In one or more embodiments of the invention, similarities in the oilfield data sets among the collection of oilfield entities (e.g., a large number of reservoirs) may be displayed using a Self-Organizing Map (SOM) (e.g., SOM (711) as shown in FIG. 7B). As is known in the art, a self-organizing map is a type of artificial neural network typically presented as discretized maps (e.g., individual maps of SOM (711)) of training data rendered in color according to a color gradient bar, which maps data values to various colors. The colors are omitted in the exemplary SOM (711) for clarity. These discretized maps may consist of arrangements of locations (e.g., location 710) with a regular spacing in a hexagonal or rectangular grid. Locations in each of the maps are superimposed among the maps to make up a location of the SOM. Each location is associated with a position in a map and a weight vector of the same dimension as the input data vectors of the training data. In one or more embodiments of the invention, the first artificial neural network described with respect to Step 702 may be a SOM and the input vectors are oilfield data sets (e.g., rows in data table (714) and (713)) for the oilfield entities involved in training the network where the dimension of the input vector is the number of data fields (e.g., identified in multiple fields of the first row of data table (714)) of the oilfield data sets. Each data field of the oilfield data sets may be represented as a map of the SOM where a vector (i.e., an oilfield data set of an oilfield entity) from data space (i.e., oilfield data sets of the collection of oilfield entities) is placed onto a map location with the weight vector closest to the vector taken from data space. Typically for a large collection of training data, multiple vectors sufficiently close to a weight vector may all be placed at a same location. For example, sufficiently similar reservoir-level data sets for multiple reservoirs may be placed at a single location of the SOM.

In one or more embodiments of the invention, an oilfield data set with a reconstructed and back-populated data field may then be incorporated in the SOM at a SOM location. In one or more embodiments of the invention, probability information may be obtained based on the SOM. For example, the measurement of the variability in all oilfield data sets placed at this SOM location may define the uncertainty range of the back-populated data field from which probability information (e.g., a probability distribution or a combination of mean value, standard deviation, and uncertainty) for each SOM location can be extracted. In addition, probability information of originally populated data fields generated from the statistical relationships of the first artificial neural network may in turn be reflected in the variability of the back-populated data fields. In one or more embodiments of the invention, multi-dimensional cross-plots and blind tests may be performed to control the quality of the back-populated oilfield data sets. Moreover, probability information of both the originally populated data fields and the back-populated data fields may also be analyzed to identify outliers that may indicate inconsistency of members in the oilfield data sets. Accordingly, validation ranges for data fields may be established against which originally populated data fields and/or back-populated data fields may be validated. In one or more embodiments of the invention, the back-populated oilfield data sets may be a stochastic database including these various probability and validation information for the corresponding oilfield entities.

Returning to FIG. 7A, oilfield operations may then be performed based at least on the back-populated oilfield data sets (Step 704). In one or more embodiments of the invention, the oilfield operations may include Enhanced Oil Recovery (EOR) processes such as waterflood operation. In one or more embodiments of the invention, the back-population of incomplete data sets and the creation of the stochastic database capture confidence levels for oilfield data from a large collection of oilfield entities (e.g., reservoirs, wells, completions, etc.). This confidence, or certainty, may be used directly for data analysis and interpretation that typically follow data gathering and reviewing processes in many oilfield workflows. The classical "data validation" process, for example, may then be shifted and moved to the interpretation workflow, where the uncertainty of the data is reduced.

Waterflooding is among the oldest and perhaps most economical of Enhanced Oil Recovery (EOR) processes to extend field life and increase ultimate oil recovery from naturally depleting reservoirs. Current high oil prices provide incentive for companies to look deeper into their reservoir portfolios for additional waterflooding opportunities. Time and information constraints can limit the depth and rigor of such a screening evaluation. Time is reflected by the effort of screening a vast number of reservoirs for the applicability of implementing a waterflood, whereas information is reflected by the availability of data (consistency of measured and modeled data) with which to extract significant knowledge necessary to make good development decisions.

Figure 8A:
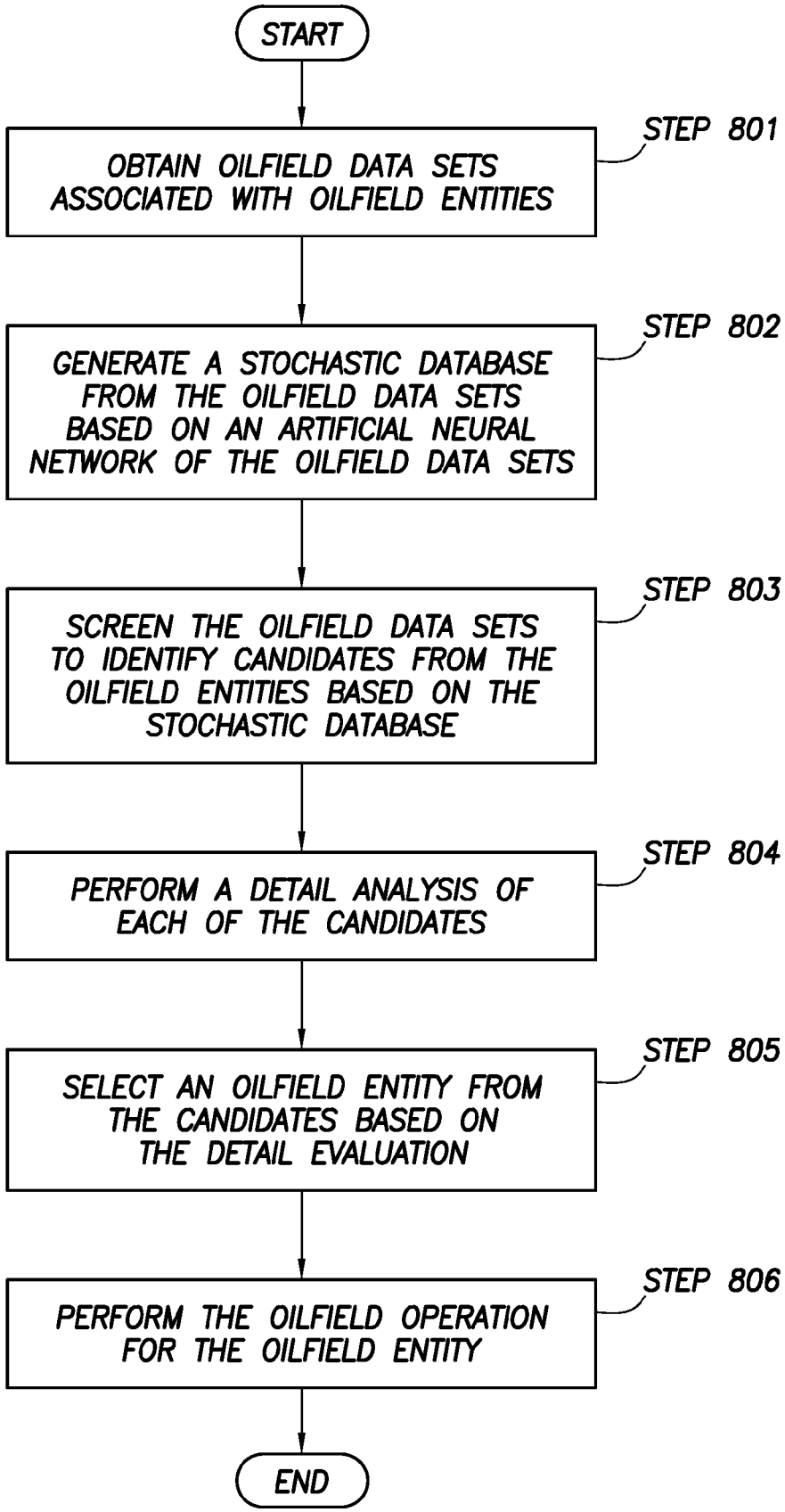
FIGS. 8A and 8B show flow charts of a screening method for identifying oilfield entity candidates in accordance with one or more embodiments of the invention.
Figure 8B:
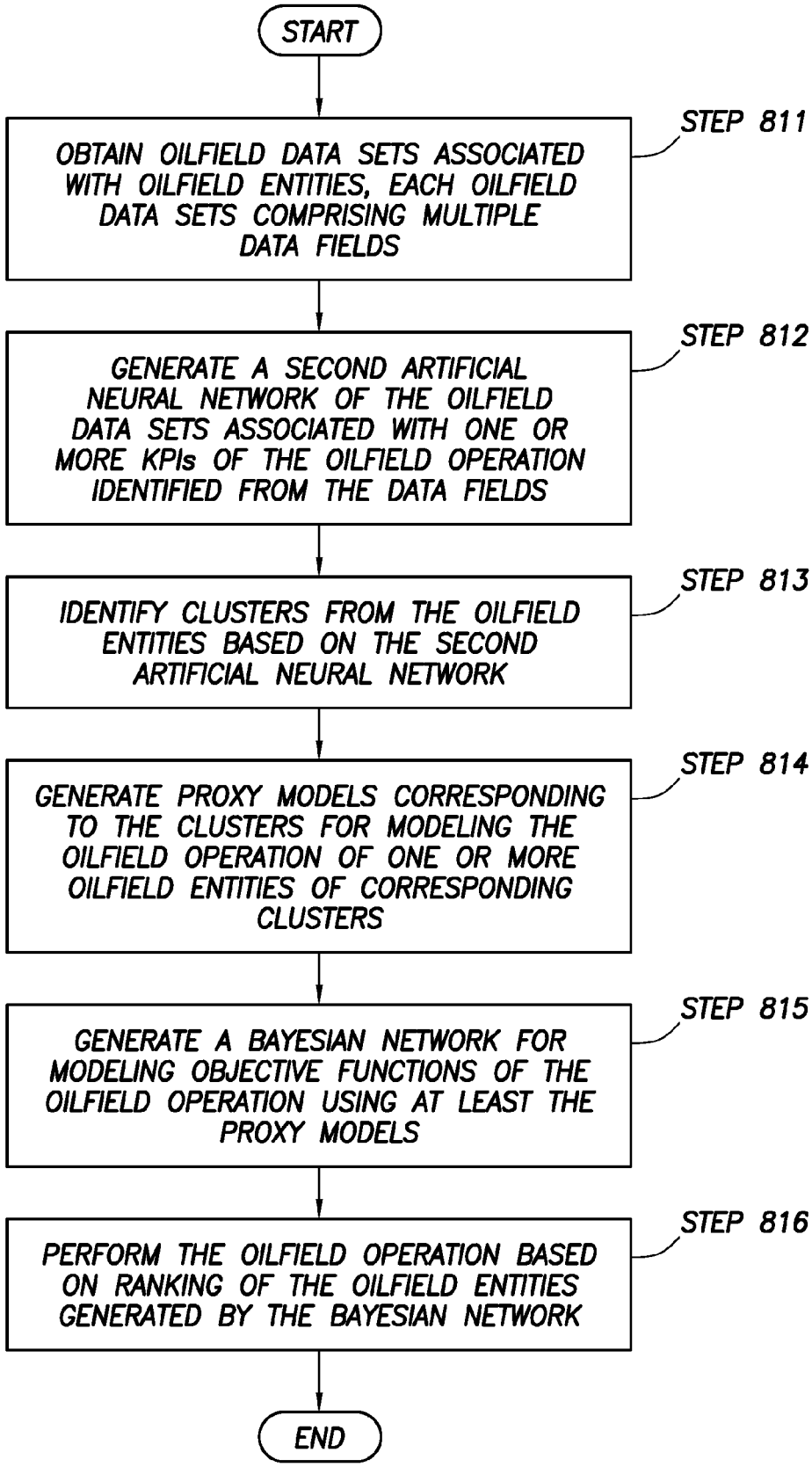

FIGS. 8A and 8B show flow charts of a screening method for identifying oilfield entity candidates in accordance with one or more embodiments of the invention. In one or more embodiments of the invention, one or more of the steps shown in FIGS. 8A and 8B may be omitted, repeated, and/or performed in a different order. Accordingly, embodiments of the invention should not be considered limited to the specific arrangements of steps shown in FIGS. 8A and 8B.

The method as shown in FIGS. 8A and 8B may be practiced in the oilfield described with respect to FIGS. 1A-5 above. Initially in FIG. 8A, oilfield data sets associated with a collection of oilfield entities may be obtained (Step 801). In one or more embodiments of the invention, the oilfield data sets may be the same as the initial oilfield data sets with unpopulated data fields as described with respect to Step 701 above. In one or more embodiments of the invention, the oilfield data sets may be the same as the back-populated oilfield data sets as described with respect to Step 703 above. In one or more embodiments of the invention, the oilfield data sets may not have un-populated data field or may have been back-populated based on other suitable schemes.

The oilfield data sets for a large collection of oilfield entities typically exhibits statistical variations and distributions in various data fields. Statistical methods may be applied to generate probability information such as probability distribution or combination of mean value, standard deviation, and uncertainty to form a stochastic data base with the oilfield data sets. In one or more embodiments of the invention, the stochastic database is generated from the oilfield data sets based on an artificial neural network (Step 802). In one or more embodiments of the invention, the oilfield data sets may be the back-populated oilfield data sets and the stochastic database may be generated based on the first artificial neural network as described with respect to Step 703 above. In one or more embodiments of the invention, the stochastic database may further include probability information generated based on a second artificial neural network as described with respect to FIG. 8B below.

Various statistical and modeling techniques may then be applied to screen the stochastic database to identify candidates from the oilfield entities for further analysis (Step 803). In one or more embodiments of the invention, proxy models (e.g., as described with respect to FIG. 5 above) may be used to model oilfield operations (e.g., EOR operations, etc.) efficiently for each of a large number of reservoirs for screening purposes. More details of exemplary statistical and modeling techniques are described with respect to FIG. 9B below. Accordingly, detail analysis may then be performed of each of the candidates selected from the screening process (Step 804). For example, the detail analysis may be performed using a full reservoir simulation model with increased accuracy, but reduced speed as described with respect to FIG. 5 above.

Returning to FIG. 8A, one or more entities may then be selected from the candidates based on the detail analysis (Step 805), Thus, these one or more entities are identified based on the two phase process. In the first phase, quick screening is performed in a large collection of oilfield entities based on a stochastic database taking into account consistency and confidence level of oilfield data. In the second phase, detail analysis is further applied to obtain more accurate assessment for final selection of the one or more candidates. Oilfield operations may then be performed for these one or more oilfield entities (Step 806).

FIG. 8B shows exemplary statistical and modeling techniques for screening large number of oilfield entities. Initially, oilfield data sets associated with a collection of oilfield entities may be obtained (Step 811). In one or more embodiments of the invention, the oilfield data sets may be the same as the initial oilfield data sets with unpopulated data fields as described with respect to Step 701 above. In one or more embodiments of the invention, the oilfield data sets may be the same as the back-populated oilfield data sets as described with respect to Step 703 above. In one or more embodiments of the invention, the oilfield data sets may not have un-populated data field or may have been back-populated based on other suitable schemes. In one or more embodiments of the invention, the oilfield data sets may be a stochastic database as described with respect to Step 802 above. In one or more embodiments of the invention, the oilfield data sets may not be associated with probability information initially.

As is known in the art, important information for each particular oilfield operation may be indicated by certain data fields in the oilfield data set. These critical data fields are key performance indicators (KPIs) for the respective oilfield operation. For example, reservoir-level parameters such as bubble point pressure, compressibility, formation volume factor (FVF), initial pressure, gas oil ratio (GOR), permeability (K), gas cap volume to oil volume ratio (m-ratio), oil thickness, viscosity, gravity, porosity, and water saturation ($S_w$) are considered KPIs in identifying candidates for waterflooding operation from a large number of reservoirs. In one or more embodiments of the invention, a second artificial neural network may be generated for the oilfield data sets associated with the KPIs (Step 812). In one or more embodiments of the invention, the second artificial neural network includes all the identified KPIs as outputs such that statistical relationships between these KPIs and other data fields in the oilfield data sets are identified.

Figure 9A:
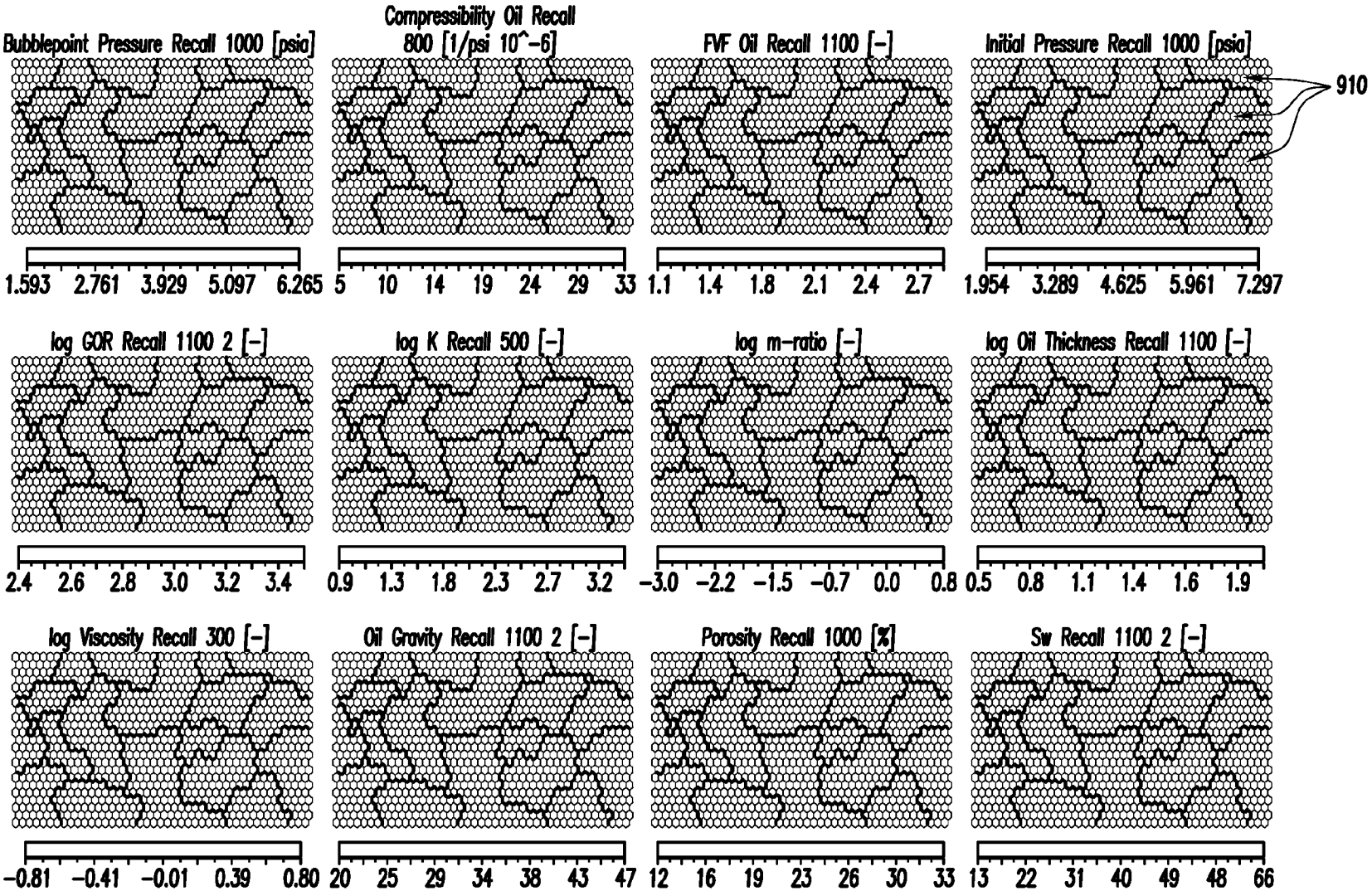
FIGS. 9A and 9B show exemplary Self-Organizing-Maps (SOMs) in accordance with one or more embodiments of the invention.

In one or more embodiments of the invention, the second artificial neural network may be a SOM including maps each representing one of the KPIs (e.g., KPIs described with respect to waterflooding operation above) such as shown in FIG. 9A. The colors are omitted in FIG. 9A for clarity. As is known in the art, SOM is particularly suitable for detecting statistical patterns exhibited in large collection of data. In one or more embodiments of the invention, clusters may be identified based on the second artificial neural network (e.g., the SOM of FIG. 9A) (Step 813). As shown in FIG. 9A, clusters (e.g., clusters (910)) may each include multiple SOM locations clustered and enclosed in a boundary indicated by the darkened trace. The exemplary SOM includes approximately 950 locations shown as hexagonal cells, which are clustered into 19 clusters defined by the darkened boundaries.

Figure 9B:
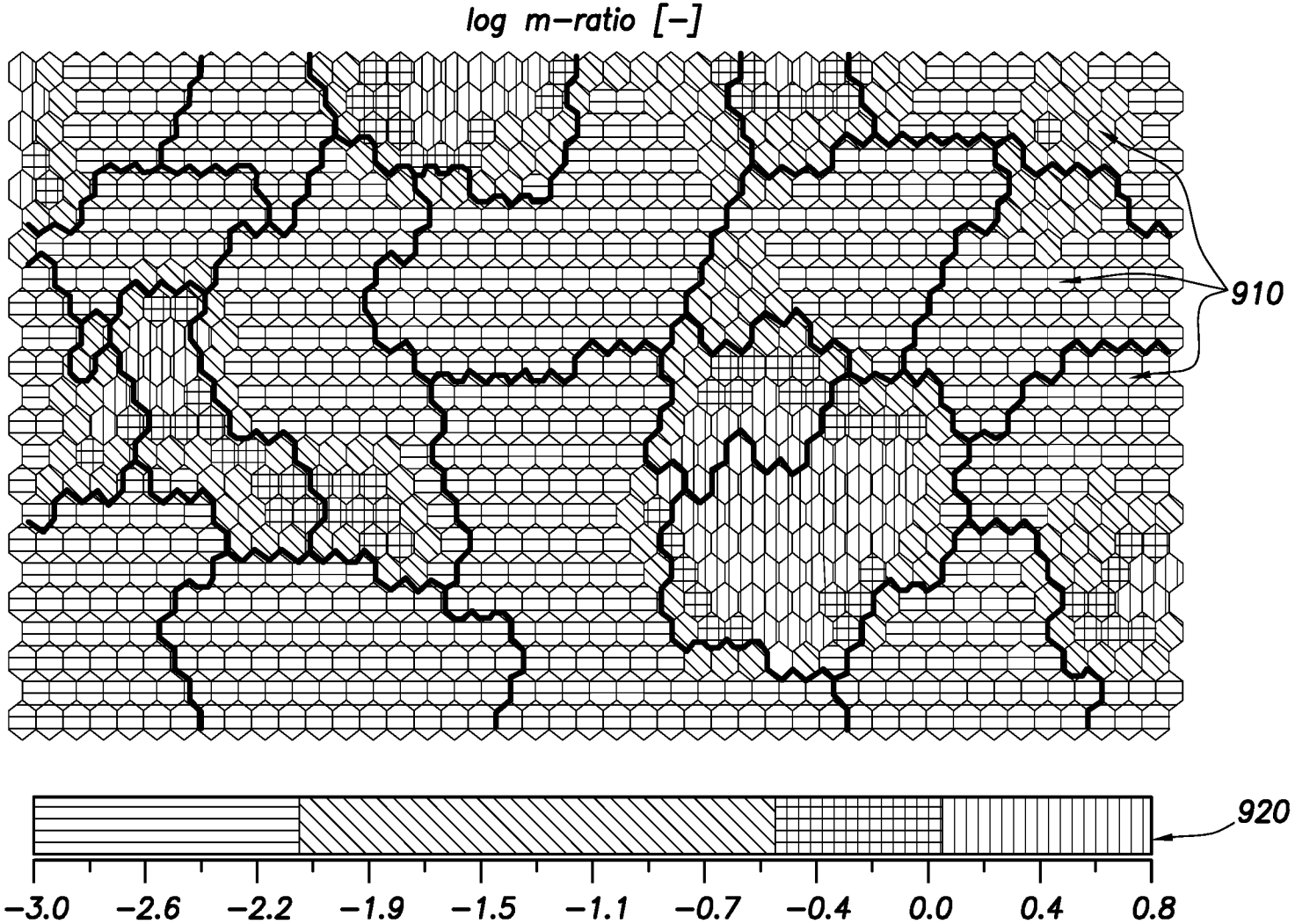

More details of one map of the exemplary SOM is shown in FIG. 9B. This map represents the "log m-ratio" parameter of the KPIs for waterflooding operation. In FIG. 9B, the color gradient bar (920) is shown as four cross-hatched sections to schematically represent a continuous color gradation mapped to a range from −3.0 to 0.8 for the value of the parameter "log m-ratio". The cross-hatched pattern of each hexagonal cell represents the parameter value of corresponding reservoirs placed at the location based on the SOM algorithm. As is expected, reservoirs within a cluster has similar parameter values while reservoirs with dissimilar parameter values tend to be in separate clusters. In one or more embodiments of the invention, the clusters may be generated automatically by the SOM algorithm. In one or more embodiments of the invention, the automatic cluster generation by the SOM algorithm may be guided by user inputs. For example, the total number of clusters may be determined or otherwise constrained by a user input. In one or more embodiments of the invention, the clusters may be generated manually by visually analyzing the SOM.

Based on the functionality of SOM, oilfield entities (e.g., reservoirs) corresponding to these SOM locations of each cluster tend to be similar in behavior with respect to the KPIs and the relationship of KPIs to other data fields of the oilfield data sets. Therefore, proxy models may be generated corresponding to the clusters for modeling the oilfield operation (Step 814). Each proxy model may be used to model the oilfield entities associated with the corresponding cluster. In one or more embodiments of the invention, each of the proxy models includes a nominal model and a response surface where the nominal model models the oilfield operation of a representative oilfield entity of the corresponding cluster and the response surface represents sensitivities of the oilfield operation to deviations from the representative oilfield entity among oilfield entities within the corresponding cluster. The representative oilfield entity may be a statistical average of oilfield entities associated with the corresponding cluster instead of a physical entity.

In one or more embodiments of the invention, variations in each KPI parameters for oilfield entities associated with each cluster may be analyzed to derive a statistical distribution for design of experiment in modeling the oilfield operation using the proxy models. The statistical distributions derived for the clusters may also be incorporated into the stochastic database as part of the probability information.

Returning to FIG. 8B, a Bayesian network may be generated for modeling objective functions of the oilfield operation using these proxy models (Step 815). The objective functions may include numerical analysis of relevant production outputs, as well as other aspects of the oilfield operation such as economical, physical, environmental, security, and other relevant aspects. In one or more embodiments of the invention, the modeling is performed for a large collection of oilfield entities using these proxy model for speed purpose. In one or more embodiments of the invention, these proxy model may be supplemented by other logical or statistical deduction techniques (e.g., using expert knowledge) based on the oilfield data sets. More details of the Bayesian network and objective function modeling are described with respect to FIG. 10 below. The objective functions may then be modeled to generate ranking for the collection of oilfield entities under consideration for the oilfield operation. In turn the oilfield operation may be performed based on the ranking of the oilfield entities generated by the Bayesian network (Step 816).

Figure 10:
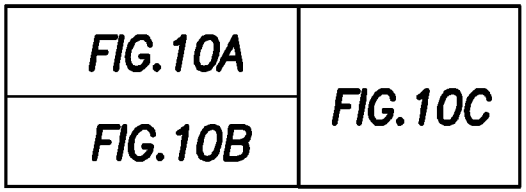
FIG. 10 (depicted as FIG. 10A-10C for illustrative purposes) shows an exemplary Bayesian network in accordance with one or more embodiments of the invention.
Figure 10A:
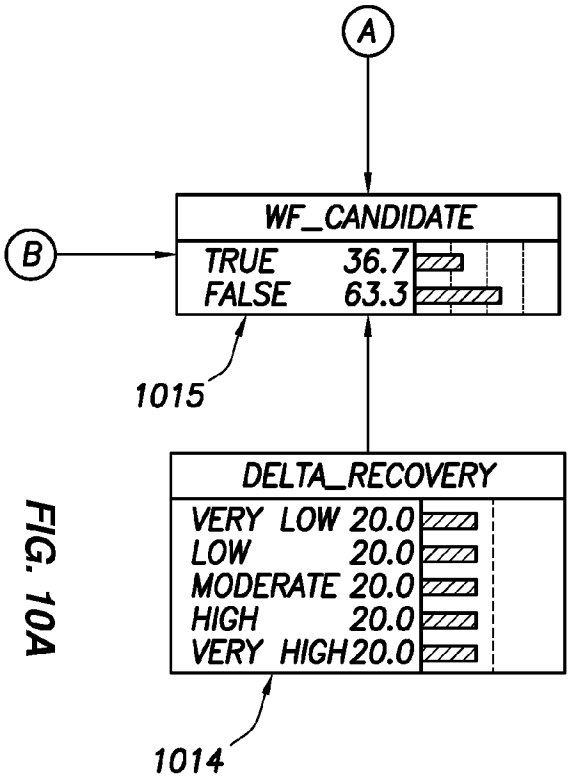
Figure 10B:
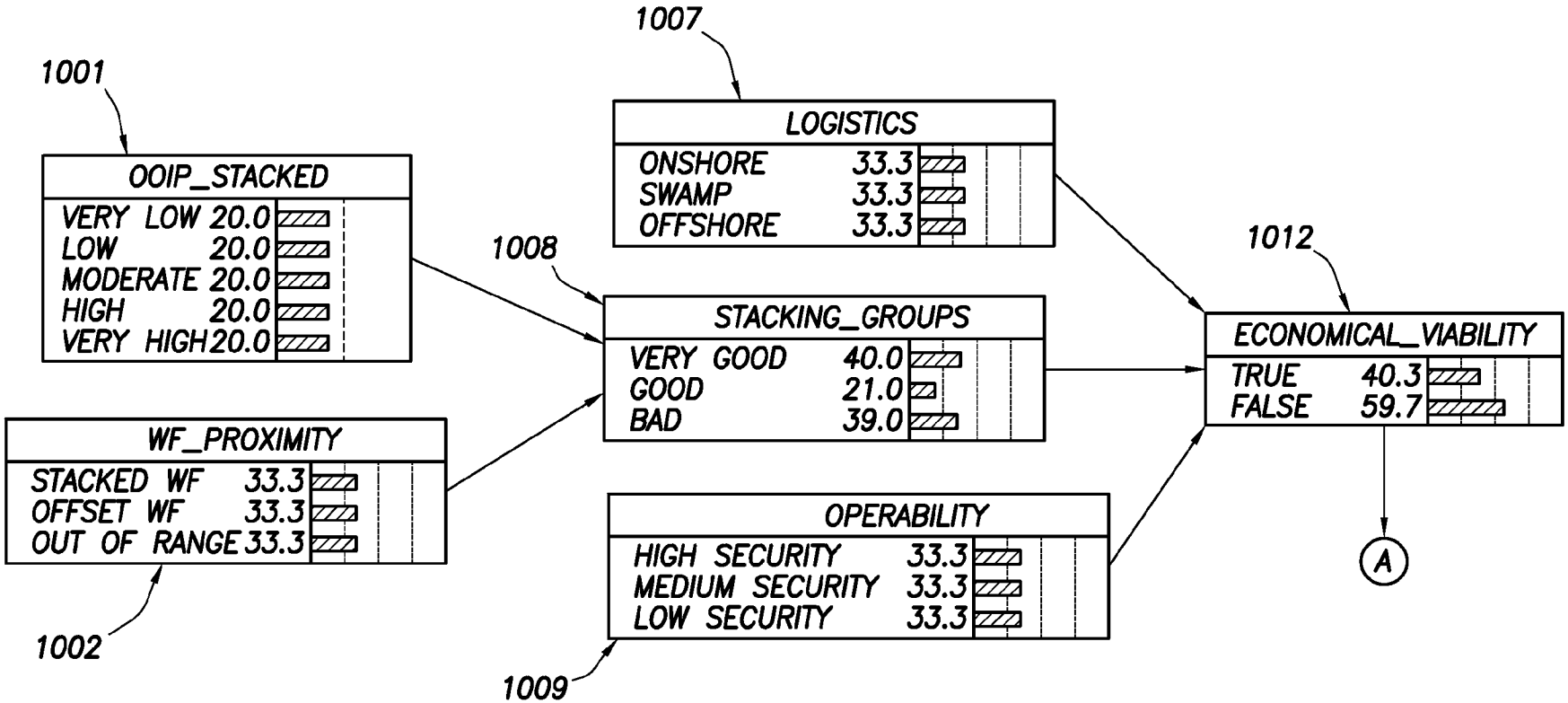
Figure 10C:
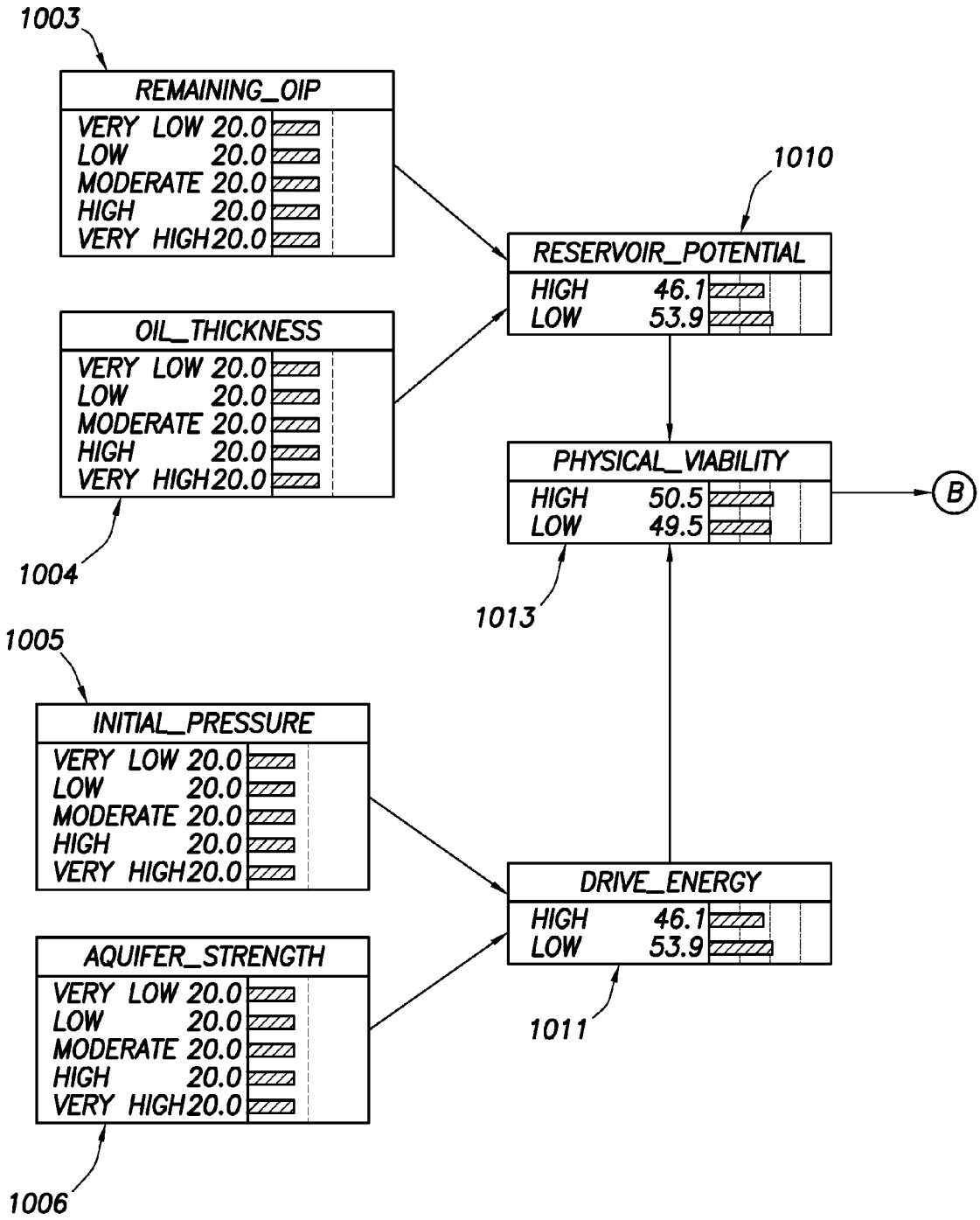

FIG. 10 (depicted as FIGS. 10A-10C for illustrative purposes) shows an exemplary Bayesian network in accordance with one or more embodiments of the invention. As is known in the art, Bayesian network is a probabilistic model that represents a set of variables with probabilistic interdependence and is typically used for guiding reasoning process in decision making. As shown in FIG. 10, the Bayesian network includes variables (1001)-(1015) where each variables includes a pre-determined number of states associated with probability percentages. The arrows connecting these variables represents underlying interdependence relationships from which the probability information of each variables may be derived. While the structure of the interconnected variables applies to all oilfield entities under consideration, the probability percentages associated with each variable are individually determined for each of the oilfield entities based on the oilfield data set corresponding to the oilfield entity.

In the exemplary Bayesian network shown in FIG. 10, the variable (1015) represents waterflooding candidate to be selected or identified from a large number of reservoirs under consideration. The probability percentages of the two states "true" and "false" are shown to depend on three other variables (1012)-(1014), which may be considered as objective functions in identifying the candidate. The variables (1012) and (1013) represent economical viability aspect and physical viability aspect, respectively, of a particular reservoir for performing waterflooding operation. The probability percentages of the two states "true" and "false" associated with the variables (1012) and (1013) are shown to further depend on additional variables (1001)-(1011), which represents original oil-in-place, waterflooding proximity, remaining oil-in-place, oil thickness, initial pressure, aquifer strength, logistics, stacking groups, operability, reservoir potential, drive energy, respectively. These various variables may be associated with relevant probability percentages derived from data fields of oilfield data set of the particular reservoir or derived from probability percentages associated with upstream variables indicated by the connecting arrows of the Bayesian network.

Further as shown in the exemplary Bayesian network of FIG. 10, the variable (1014) represents incremental production of the particular reservoir as a result if waterflooding operation is performed. In one or more embodiments of the invention, the oilfield data sets is a stochastic database and probability percentages associated with the incremental production is determined based on Monte Carlo simulation using the proxy models as described with respect to Step 814 based on probability information in the stochastic database (Step 815).

Returning to FIG. 10, the probability percentages of the variable (1015) may then be determined for each oilfield entity under consideration as candidate for performing the oilfield operation based on probability information of the stochastic database as described above. The collection of the oilfield entities under consideration may then be ranked based on the respective probability percentages of the variable (1015). Accordingly, the oilfield operation may then be performed based on the ranking as described with respect to Step 816 of FIG. 8B above. In one or more embodiments of the invention, top tanked candidates may be selected for performing the oilfield operation. In one or more embodiments of the invention, top tanked candidates may be subjected to additional detail analysis for selecting final candidates to perform the oilfield operation as described with respect to Step 804 of FIG. 8A above.

Using the screening method described above, more than 1500 reservoirs may be screened and reduced to about 100 reservoir candidates (i.e., an order of magnitude difference) that are suitable for a more detailed evaluation. By also using the screening method described above, 1700 reservoirs, each with more than 200 parameters, may be reduced to a smaller number of reservoir candidates suitable for water-flooding operations to improve production and recovery. The processing time to rank the reservoirs may be three months, which is significantly less than prior methods.

Those skilled in the art, having the benefit of this detailed description, will appreciate that prior screening processes suffer from the fact that most databases are incomplete and hence many candidates fall through the screening process because of incomplete data. Furthermore, those skilled in the art, having the benefit of this detailed description, will appreciate populated databases are very biased and concentrated on a few parameters that might affect the screening criteria. In contrast, in one or more embodiments of the invention, the entire screening process is solved in stochastic space using stochastic back-populated databases in connection with proxy models that can describe a complex technical process or a subjective decision or the opinion of an expert system. These proxies feed into a Bayesian network, which derives the stochastic ranking of each candidate. The benefit of this approach is in the inclusion of a wide range of influencing parameters while at the same time speeding up the screening process without jeopardizing the quality of the results.

Although the examples discussed above relate to identify waterflooding candidates based on reservoir-level data sets, the methods of the present invention described above may be applied to other oilfield entities and oilfield operations. For example, a workflow is introduced that uses the response surface from an uncertainty analysis on an accurate numerical well model. In one or more embodiments of the invention, the response surface from the well model is transferred to a proxy model that connects the input range of each uncertainty parameter with a probabilistic output for the individual completion flow. In one or more embodiments of the invention, a neural network is trained on the stochastic input and output and is able to back-calculate the production share of the actual well in real-time.

Those skilled in the art, having the benefit of this detailed description, will appreciate back-allocation from the wellhead to the completion is difficult to achieve using prior methods. The prior methods that could deliver the production share in real-time usually fail to provide accurate results when the inflow performance of one completion changes. Numerical modeling, which accounts for the mobility change and the resulting re-distribution of the pressure in the open system of the completion, is time consuming and usually cannot be used for back-allocation in real-time.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method of performing an oilfield operation, comprising:

obtaining a plurality of oilfield data sets each corresponding to one of a plurality of oilfield entities and comprising a plurality of data fields;

generating a stochastic database from the plurality of oilfield data sets based on an artificial neural network of the plurality of oilfield data sets, wherein the artificial neural network comprises a self organizing map (SOM) having a plurality of SOM locations and comprising a plurality of maps screening the plurality of oilfield data sets to identify a plurality of candidates from the plurality of oilfield entities, wherein the screening is based on the stochastic database;

performing a detail evaluation of each of the plurality of candidates;

selecting an oilfield entity from the plurality of candidates based on the detail evaluation; and performing the oilfield operation for the oilfield entity.

2. The method of claim 1, further comprising generating the SOM by:

assigning each of the plurality of data fields to one of the plurality of maps of the SOM; and assigning each of the plurality of oilfield entities to one of the plurality of SOM locations based on a pre-determined SOM algorithm to represent statistical patterns in the plurality of oilfield data sets;

wherein the stochastic data base comprises probability information obtained based on the SOM and associated with at least one of the plurality of data fields, and wherein the probability information comprises at least one selected from a group consisting of probability distribution and a combination of mean value, standard deviation, and uncertainty.

3. The method of claim 1, wherein the oilfield operation comprises at least one selected from a group consisting of Enhanced Oil Recovery (EOR) operation and back-allocation of oilfield production from a plurality of commingled wells.

4. A method of performing an oilfield operation, comprising:

obtaining a plurality of oilfield data sets each corresponding to one of a plurality of oilfield entities and comprising a plurality of data fields, at least one data field of the plurality of data fields of at least one oilfield data set of the plurality of oilfield data sets being an un-populated data field;

generating an artificial neural network of the plurality of oilfield data sets, the artificial neural network comprising one or more relationships among the plurality of data fields;

populating the un-populated data field of the at least one oilfield data set by an estimated data based on the one or more relationships;

generating, from the plurality of oilfield data sets and in response to populating the un-populated data field, a self organizing map (SOM) having a plurality of SOM locations and comprising a plurality of maps;

identifying a plurality of clusters from the plurality of SOM locations based on the pre-determined SOM algorithm, each of the plurality of clusters corresponding to a portion of the plurality of oilfield entities having substantially similar parameter values in the plurality of oilfield data sets; and performing the oilfield operation based on the portion of the plurality of oilfield entities having substantially similar parameter values in the plurality of oilfield data sets.

5. The method of claim 4, wherein the plurality of oilfield entities comprise at least one selected from a group consisting of a reservoir, a well, and a completion.

6. The method of claim 4, wherein the SOM is generated by:

assigning each of the plurality of data fields to one of the plurality of maps of the SOM; and assigning each of the plurality of oilfield entities to one of the plurality of SOM locations based on a pre-determined SOM algorithm to represent statistical patterns in the plurality of oilfield data sets, further comprising:

generating probability information of the estimated data based on the artificial neural network, wherein the probability information comprises at least one selected from a group consisting of probability distribution and a combination of mean value, standard deviation, and uncertainty.

7. The method of claim 4, wherein the plurality of data fields comprise one or more key performance indicators (KPIs) of the oilfield operation.

8. The method of claim 7, wherein the plurality of oilfield entities comprise at least one selected from a group consisting of a reservoir, a well, and a completion.

9. The method of claim 7, wherein the each of the plurality of proxy models comprises a nominal model and a response surface, wherein the nominal model models the oilfield operation of a representative oilfield entity of the portion of the plurality of oilfield entities associated with the cluster, and wherein the response surface represents sensitivities of the oilfield operation to deviations of the portion of the plurality of oilfield entities from the representative oilfield entity.

10. The method of claim 7, wherein the oilfield operation comprises at least one selected from a group consisting of Enhanced Oil Recovery (EOR) operation and back-allocation of oilfield production from a plurality of commingled wells.

11. The method of claim 7, further comprising:

identifying one or more objective functions of the oilfield operation;

generating a Bayesian network for modeling the one or more objective functions using at least the plurality of proxy models;

generating a ranking of the plurality of oilfield entities based on the Bayesian network; and performing the oilfield operation based on the ranking.

12. The method of claim 11, further comprising:

generating a probability distribution for at least one of the plurality of data fields based on the artificial neural network, wherein the Bayesian network is generated based on Monte-Carlo simulation with the probability distribution using the plurality of proxy models.

13. The method of claim 11, further comprising:

identifying one or more candidates from the plurality of oilfield entities based on the ranking;

performing detail analysis of the one or more candidates; and selecting, based on the detail analysis, a final candidate from the one or more candidates to perform the oilfield operation.

14. A method of performing an oilfield operation, comprising:

obtaining a plurality of oilfield data sets each corresponding to one of a plurality of oilfield entities and comprising a plurality of data fields;

generating, from the plurality of oilfield data sets, a self organizing map (SOM) having a plurality of SOM locations and comprising a plurality of maps;

identifying a plurality of clusters from the plurality of SOM locations based on the pre-determined SOM algorithm, each of the plurality of clusters corresponding to a portion of the plurality of oilfield entities having substantially similar parameter values in the plurality of oilfield data sets;

generating a plurality of proxy models each corresponding to a cluster of the plurality of clusters and for modeling the oilfield operation of the portion of the plurality of oilfield entities associate with the cluster; and performing the oilfield operation based on the plurality of proxy models.

15. The method of claim 14, wherein the plurality of data fields comprise one or more key performance indicators (KPIs) of the oilfield operation, and wherein the plurality of oilfield entities comprise at least one selected from a group consisting of a reservoir, a well, and a completion.

16. The method of claim 14, wherein the SOM is generated by:

assigning each of the plurality of data fields to one of the plurality of maps of the SOM; and assigning each of the plurality of oilfield entities to one of the plurality of SOM locations based on a pre-determined SOM algorithm to represent statistical patterns in the plurality of oilfield data sets, wherein the each of the plurality of proxy models comprises a nominal model and a response surface, wherein the nominal model models the oilfield operation of a representative oilfield entity of the portion of the plurality of oilfield entities associated with the cluster, and wherein the response surface represents sensitivities of the oilfield operation to deviations of the portion of the plurality of oilfield entities from the representative oilfield entity.

17. The method of claim 14, wherein the oilfield operation comprises at least one selected from a group consisting of Enhanced Oil Recovery (EOR) operation and back-allocation of oilfield production from a plurality of commingled wells.

18. The method of claim 14, further comprising:

identifying one or more objective functions of the oilfield operation;

generating a Bayesian network for modeling the one or more objective functions using at least the plurality of proxy models;

generating a ranking of the plurality of oilfield entities based on the Bayesian network; and performing the oilfield operation based on the ranking.

19. The method of claim 18, wherein each of the plurality of data fields is associated with a probability distribution, and wherein the Bayesian network is generated based on Monte-Carlo simulation with the probability distribution using the plurality of proxy models.

20. The method of claim 18, further comprising:

identifying one or more candidates from the plurality of oilfield entities based on the ranking;

performing detail analysis of the one or more candidates; and selecting, based on the detail analysis, a final candidate from the one or more candidates to perform the oilfield operation.

21. A surface unit comprising a memory and a processor, embodying instructions stored in the memory and executable by the processor to perform method steps to perform an oilfield operation, the instructions comprising functionality to:

obtain a plurality of oilfield data sets each corresponding to one of a plurality of oilfield entities and comprising a plurality of data fields;

generate a stochastic database from the plurality of oilfield data sets based on an artificial neural network of the plurality of oilfield data sets, wherein the artificial neural network comprises a self organizing map (SOM) having a plurality of SOM locations and comprising a plurality of maps;

screen the plurality of oilfield data sets to identify a plurality of candidates from the plurality of oilfield entities, wherein the screening is based on the stochastic database;

perform a detail evaluation of each of the plurality of candidates;

select an oilfield entity from the plurality of candidates based on the detail evaluation; and perform the oilfield operation for the oilfield entity.

22. A surface unit comprising a memory and a processor, embodying instructions stored in the memory and executable by the processor to perform method steps to perform an oilfield operation, the instructions comprising functionality to:

obtain a plurality of oilfield data sets each corresponding to one of a plurality of oilfield entities and comprising a plurality of data fields, at least one data field of the plurality of data fields of at least one oilfield data set of the plurality of oilfield data sets being an un-populated data field;

generate a artificial neural network of the plurality of oilfield data sets, the artificial neural network comprising one or more relationships among the plurality of data fields;

populate the un-populated data field of the at least one oilfield data set by an estimated data based on the one or more relationships;

generate, from the plurality of oilfield data sets and in response to populating the un-populated data field, a self organizing map (SOM) having a plurality of SOM locations and comprising a plurality of maps;

identify a plurality of clusters from the plurality of SOM locations based on the pre-determined SOM algorithm, each of the plurality of clusters corresponding to a portion of the plurality of oilfield entities having substantially similar parameter values in the plurality of oilfield data sets; and perform the oilfield operation based on the portion of the plurality of oilfield entities having substantially similar parameter values in the plurality of oilfield data sets.

23. A surface unit comprising a memory and a processor, embodying instructions stored in the memory and executable by the processor to perform method steps to perform an oilfield operation, the instructions comprising functionality to:

obtain a plurality of oilfield data sets each corresponding to one of a plurality of oilfield entities and comprising a plurality of data fields;

generate, from the plurality of oilfield data sets, a self organizing map (SOM) having a plurality of SOM locations and comprising a plurality of maps;

identify a plurality of clusters from the plurality of SOM locations based on the pre-determined SOM algorithm, each of the plurality of clusters corresponding to a portion of the plurality of oilfield entities having similar parameter values in the plurality of oilfield data sets;

generate a plurality of proxy models each corresponding to a cluster of the plurality of clusters and for modeling the oilfield operation of the portion of the plurality of oilfield entities associate with the cluster; and perform the oilfield operation based on the plurality of proxy models.

* * * * *